US010571136B2

(12) United States Patent
Cai et al.

(10) Patent No.: US 10,571,136 B2
(45) Date of Patent: Feb. 25, 2020

(54) INDOOR UNIT OF AIR CONDITIONER

(71) Applicants: GD MIDEA AIR-CONDITIONING EQUIPMENT CO., LTD., Foshan (CN); MIDEA GROUP CO., LTD., Foshan (CN)

(72) Inventors: Zhicai Cai, Foshan (CN); Xing Liu, Foshan (CN); Xiaofeng Bai, Foshan (CN); Xinzhou Zhang, Foshan (CN)

(73) Assignees: GD MIDEA AIR-CONDITIONING EQUIPMENT CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 145 days.

(21) Appl. No.: 15/325,498

(22) PCT Filed: Mar. 31, 2015

(86) PCT No.: PCT/CN2015/075629
§ 371 (c)(1),
(2) Date: Jan. 11, 2017

(87) PCT Pub. No.: WO2016/154952
PCT Pub. Date: Oct. 6, 2016

(65) Prior Publication Data

US 2018/0010811 A1 Jan. 11, 2018

(51) Int. Cl.
*F24F 1/0025* (2019.01)
*F24F 1/0057* (2019.01)
(Continued)

(52) U.S. Cl.
CPC ..... *F24F 1/0025* (2013.01); *F24F 1/0057* (2019.02); *F24F 13/20* (2013.01);
(Continued)

(58) Field of Classification Search
None
See application file for complete search history.

(56) References Cited

U.S. PATENT DOCUMENTS 3,425,621 A * 2/1969 Greenheck ..... F04D 17/165 417/362
3,871,795 A * 3/1975 Habdo ..... F04D 17/165 417/360

(Continued)

FOREIGN PATENT DOCUMENTS

CN 102374638 * 3/2012 ..... F24F 13/32
CN 102374638 A * 3/2012

(Continued)

OTHER PUBLICATIONS

Australian Patent Application No. 2015388525, Examination Report dated Nov. 10, 2017, 5 pp.

(Continued)

*Primary Examiner* — Gregory L Huson
*Assistant Examiner* — Frances F. Hamilton
(74) *Attorney, Agent, or Firm* — Anova Law Group PLLC

(57) ABSTRACT

An indoor unit (1000) of an air conditioner includes a housing (100) having an upper base plate (110) provided with an air inlet (101), a lower base plate (120) detachably mounted to the upper base plate (110) and provided with an air outlet, and a front cover (130) detachably mounted to the upper base plate (110); a heat exchanger (140) mounted on the upper base plate (110); a fan (142) detachably mounted to the lower base plate (120); and a thrust structure (340) having a body (350) that is disposed to a rear portion of the indoor unit (1000) and has a thrust face (351) abutting against a mounting member to limit a degree of freedom of upward movement of the indoor unit (1000).

23 Claims, 15 Drawing Sheets

(51) Int. Cl.
*F24F 13/32* (2006.01)
*F24F 13/20* (2006.01)
*F24F 13/30* (2006.01)

(52) U.S. Cl.
CPC ..... *F24F 13/30* (2013.01); *F24F 13/32* (2013.01); *F24F 2221/22* (2013.01); *F24F 2221/32* (2013.01)

(56) References Cited

U.S. PATENT DOCUMENTS

| | | | | | |
|---|---|---|---|---|---|
| 4,092,088 | A * | 5/1978 | Nemesi | F04D 17/165 415/201 |
| 5,042,269 | A * | 8/1991 | Sullivan | F04D 25/16 285/319 |
| 6,257,012 | B1 * | 7/2001 | Tesche | F04D 29/4226 415/204 |
| 6,460,363 | B1 * | 10/2002 | Moretti | F24F 1/027 62/262 |
| 8,627,672 | B2 * | 1/2014 | Moteki | F24F 1/0007 62/263 |
| 8,870,140 | B2 * | 10/2014 | Stemple | F16M 11/04 248/276.1 |
| 9,157,575 | B2 * | 10/2015 | Pei | F16M 11/10 |
| 9,297,542 | B2 * | 3/2016 | Uehara | F24F 1/0007 |
| 9,395,043 | B2 * | 7/2016 | Stifal | F16M 11/10 |
| 9,433,293 | B2 * | 9/2016 | Gross | F16M 11/10 |
| 9,441,782 | B2 * | 9/2016 | Funk | F16M 13/02 |
| 9,482,241 | B2 * | 11/2016 | Locker, Jr. | F04D 29/601 |
| 9,625,091 | B1 * | 4/2017 | Massey | F16M 13/022 |
| 9,909,711 | B2 * | 3/2018 | Steckling | F24F 13/32 |
| 10,036,561 | B2 * | 7/2018 | Liu | F24F 13/20 |
| 2010/0123059 | A1 * | 5/2010 | Saez | F16M 11/14 248/201 |
| 2010/0242518 | A1 * | 9/2010 | Yang | F24F 1/0007 62/262 |
| 2013/0037670 | A1 * | 2/2013 | Lu | F16M 11/10 248/284.1 |
| 2015/0252818 | A1 * | 9/2015 | Heli | F04D 29/646 415/213.1 |
| 2017/0138613 | A1 * | 5/2017 | Bai | F24F 13/20 |
| 2018/0010811 | A1 * | 1/2018 | Cai | F24F 13/32 |
| 2018/0017282 | A1 * | 1/2018 | Liu | F24F 13/20 |

FOREIGN PATENT DOCUMENTS

| | | | | | |
|---|---|---|---|---|---|
| CN | 102401459 | A | | 4/2012 | |
| CN | 202835744 | U | * | 3/2013 | |
| CN | 202835744 | U | * | 3/2013 | F24F 13/32 |
| CN | 103438560 | | * | 12/2013 | F24F 13/32 |
| CN | 103438560 | A | * | 12/2013 | |
| CN | 103615772 | A | * | 3/2014 | |
| CN | 103712328 | | * | 4/2014 | F24F 13/32 |
| CN | 103994562 | A | | 8/2014 | |
| CN | 103994562 | A | * | 8/2014 | |
| CN | 203964326 | U | * | 11/2014 | F24F 13/32 |
| CN | 203964326 | U | * | 11/2014 | |
| CN | 203964329 | U | * | 11/2014 | |
| CN | 203964329 | U | * | 11/2014 | F24F 13/32 |
| CN | 204176744 | U | | 2/2015 | |
| CN | 104456911 | A | * | 3/2015 | |
| CN | 104456911 | A | * | 3/2015 | F24F 13/32 |
| CN | 104728928 | A | * | 6/2015 | F24F 1/0003 |
| CN | 104728928 | A | * | 6/2015 | F24F 13/32 |
| CN | 104748235 | A | | 7/2015 | |
| CN | 104764184 | A | | 7/2015 | |
| CN | 204629998 | U | | 9/2015 | |
| CN | 103438560 | B | * | 8/2016 | F24F 13/32 |
| CN | 105917176 | A | * | 8/2016 | F24F 13/32 |
| CN | 105917176 | A | * | 8/2016 | F24F 13/32 |
| CN | 103712328 | B | * | 1/2018 | F24F 13/32 |
| CN | 104456911 | B | * | 2/2018 | F24F 13/32 |
| JP | S55116034 | A | | 9/1980 | |
| JP | H07120057 | A | | 5/1995 | |
| JP | H08135994 | A | * | 5/1996 | |
| JP | H-08135994 | A | * | 5/1996 | F24F 1/00 |
| JP | H10137698 | A | * | 5/1998 | B80B 1/00 |
| JP | 3122715 | B2 | | 1/2001 | |
| JP | 2001221497 | A | * | 8/2001 | |
| JP | 2003161459 | A | | 6/2003 | |
| JP | 2004020151 | | * | 1/2004 | F24F 1/00 |
| JP | 2004020151 | A | * | 1/2004 | |
| JP | 3729651 | B2 | * | 12/2005 | F24F 13/32 |
| JP | 4049722 | B2 | * | 2/2008 | F24F 13/32 |
| JP | 4606129 | B2 | | 1/2011 | |
| JP | 2011080626 | A | * | 4/2011 | |
| JP | 2011089678 | | * | 5/2011 | F24F 13/32 |
| JP | 5359771 | B2 | * | 12/2013 | F24F 13/32 |
| JP | 6155737 | B2 | * | 7/2017 | F24F 13/32 |
| JP | 6160156 | B2 | * | 7/2017 | F24F 13/20 |
| KR | 20030091401 | A | * | 12/2003 | |
| WO | WO-2015012588 | A1 | * | 1/2015 | F24F 1/0007 |

OTHER PUBLICATIONS

PCT/CN2015/075629 English translation of the International Search Report, dated Jan. 8, 2016, 2 pages.

European Patent Application No. 15886922.2, Extended Search and Opinion dated Oct. 22, 2018, 11 pages.

The European Patent Office (EPO), Office Action for EP Application No. 15886922.2, dated Sep. 10, 2019, 8 Pages.

* cited by examiner

E

F

INDOOR UNIT OF AIR CONDITIONER

CROSS-REFERENCE TO RELATED APPLICATION

The present application is a national phase entry under 35 USC § 371 of International Application PCT/CN2015/075629, filed Mar. 31, 2015.

FIELD

The present invention relates to a field of household appliances, and more particularly to an indoor unit of an air conditioner.

BACKGROUND

An indoor unit in the prior art has a housing, and the housing includes a base plate, a face frame mounted to the base plate, and a panel mounted to the face frame. A heat exchanger and a fan are mounted to the base plate, and a fan wheel of the fan is located at an inner side of the heat exchanger. Even though the face frame is dismounted, the fan wheel cannot be dismounted only if the heat exchanger is also dismounted, because the fan wheel is limited by the heat exchanger and the base plate together, which brings about great inconvenience to a user. The dismounting and cleaning of the fan wheel needs professional help, which results in a high cost.

SUMMARY

The present invention aims to solve at least one of the problems existing in the related art. Thus, embodiments of the present invention provide an indoor unit of an air conditioner. It is convenient to assemble or disassemble a fan of the indoor unit.

According to the embodiments of the present invention, the indoor unit includes: a housing comprising an upper base plate provided with an air inlet, a lower base plate detachably mounted to the upper base plate and provided with an air outlet, and a front cover detachably mounted to the upper base plate; a heat exchanger mounted on the upper base plate; a fan detachably mounted to the lower base plate; and a thrust structure comprising a body, the body being disposed to a rear portion of the indoor unit and having a thrust face abutting against a mounting member to limit a degree of freedom of upward movement of the indoor unit.

In the indoor unit according to the embodiments of the present invention, the fan is mounted to the lower base plate and the lower base plate is detachably mounted to the upper base plate, such that the cleaning, maintenance and repair of the fan just need to disassemble the lower base plate from the upper base plate, and hence the fan may be disassembled from the indoor unit, which avoids a problem in the prior art that the heat exchanger affects the assembling and dissembling of the fan. The convenient dismounting of the fan in the present invention facilitates cleaning a fan wheel of the fan. Moreover, the cleaning of the fan wheel does not involve the dismounting and mounting of the heat exchanger, which avoids a problem that the heat exchanger tends to break down due to the dismounting and mounting thereof, thus facilitating the maintenance of the indoor unit and reducing the failure rate of the indoor unit. Additionally, the thrust face of the body may abut against the mounting member to limit upward movement of the thrust structure, and thus the indoor unit connected with the thrust structure cannot move upwards with respect to the mounting member. That is, the degree of freedom of the upward movement of the indoor unit is restricted. In such a way, the indoor unit will not be detached from the mounting member easily under a slight upward force, and hence be mounted more firmly and reliably, which ensures that the indoor unit will not be detached from the mounting member during later cleaning and repair.

In an embodiment of the present invention, the upper base plate includes: a rear baffle, to which the heat exchanger is mounted; an upper cover plate having a rear edge connected with an upper edge of the rear baffle and provided with the air inlet therein; a left end plate having a rear edge connected with a left edge of the rear baffle and an upper edge connected with a left edge of the upper cover plate; and a right end plate having a rear edge connected with a right edge of the rear baffle and an upper edge connected with a right edge of the upper cover plate. The lower base plate is detachably mounted to the left end plate and the rear baffle, the left end plate is located at a left side of the lower base plate and the right end plate is located at a right side of the lower base plate.

In an embodiment of the present invention, the upper base plate further includes: a left shield plate mounted to a left side face of the left end plate; and a right shield plate mounted to a right side face of the right end plate. The front cover is detachably mounted to the left shield plate and the right shield plate.

In an embodiment of the present invention, an air inlet grille is provided at the air inlet of the upper cover plate.

In an embodiment of the present invention, the air inlet grille is integrally formed in the upper cover plate.

In an embodiment of the present invention, the front cover is pivotably mounted to the upper base plate.

In an embodiment of the present invention, the front cover defines a covering chamber; the upper base plate and the lower base plate are disposed in the covering chamber and covered by the front cover; and the front cover is provided with an air supply port in a position corresponding to the air outlet.

In an embodiment of the present invention, the front cover includes: a front panel covering front surfaces of the upper base plate and the lower base plate; a lower panel having a front edge connected with a lower edge of the front panel, and covering a lower surface of the lower base plate, in which the air supply port is provided at a position where the front panel and the lower panel are connected; a left panel having a front edge connected with a left edge of the front panel and a lower edge connected with a left edge of the lower panel, and rotatably mounted to a left side face of the upper base plate and covering the left side face of the upper base plate; and a right panel having a front edge connected with a right edge of the front panel and a lower edge connected with a right edge of the lower panel, and rotatably mounted to a right side face of the upper base plate and covering the right side ace of the upper base plate.

In an embodiment of the present invention, the front panel and the lower panel are connected via an arc transition portion.

In an embodiment of the present invention, the fan includes: a fan wheel detachably mounted to the lower base plate; and a motor detachably mounted to the lower base plate and connected with the fan wheel in a transmission way.

In an embodiment of the present invention, a motor mounting groove is provided in the lower base plate; the upper base plate is provided with a water receiving cover;

the motor is mounted in the motor mounting groove; and the water receiving cover is located below the heat exchanger and presses the motor in the motor mounting groove.

In an embodiment of the present invention, an air deflector is provided at the air outlet and exposed from the air supply port of the lower base plate.

In an embodiment of the present invention, an upper end face of the body is configured as the thrust face.

In an embodiment of the present invention, a lower end of the body has a stopping ramp; the body is pivotably connected to the rear portion of the indoor unit between a first position and a second position; when the body is in the first position, the stopping ramp abuts against a rear wall of the indoor unit to make an upper end of the body move rearwards away from the rear wall of the indoor unit, and open; when the body is in the second position, the thrust face abuts upwards against the mounting member to limit the degree of freedom of the upward movement of the indoor unit.

In an embodiment of the present invention, the body is provided with a resilient arm extending forwards and downwards, and a free end of the resilient arm normally abuts against the rear portion of the indoor unit.

In an embodiment of the present invention, the body is configured as an inverted U-shaped structure with a recess opening downwards, and the resilient arm is disposed in the recess.

In an embodiment of the present invention, the resilient arm is configured as an arc plate.

In an embodiment of the present invention, a pivot is disposed at each of two sides of the body, and a pivot hole is provided in the indoor unit to be fitted with the pivot.

In an embodiment of the present invention, the rear portion of the body is provided with a thrust protrusion protruding rearwards.

In an embodiment of the present invention, the body is provided with a grid-like processing groove.

In an embodiment of the present invention, the indoor unit further includes a wall-hung plate for mounting on a wall, in which the rear portion of the indoor unit is provided with a hanging groove with a downward opening, the indoor unit is hung on the wall-hung plate, an upper end of the wall-hung plate is provided with a turn-up bent forwards, and the thrust face may abut against a bottom of the turn-up.

In an embodiment of the present invention, the rear portion of the indoor unit is provided with mounting ribs protruding rearwards and disposed in pairs, and the thrust structure is pivotably mounted between two mounting ribs.

In an embodiment of the present invention, two thrust structures are provided and spaced apart.

In an embodiment of the present invention, the indoor unit includes a guide assembly for guiding the lower base plate in a process of mounting and dismounting the lower base plate. The guide assembly includes: a guide groove provided in the upper base plate, and a guide rail fitted with the guide groove and disposed on the lower base plate.

In an embodiment of the present invention, the guide groove is provided with a limiting protrusion, the guide rail is provided with a limiting groove, and the limiting protrusion is fitted in the limiting groove.

In an embodiment of the present invention, the upper base plate is provided with a connecting groove, the lower base plate is provided with a connecting protrusion, and the connecting protrusion is fitted in the connecting groove.

In an embodiment of the present invention, the lower base plate is further mounted on the upper base plate via a threaded fastener.

In an embodiment of the present invention, the indoor unit further includes a supporting rod, in which the supporting rod is rotatably mounted to a wall-hung plate or the housing between an unfolded position where a lower portion of the supporting rod for supporting the housing is away from the wall-hung plate and a folded position where the supporting rod abuts against the wall-hung plate or the housing.

In an embodiment of the present invention, the supporting rod includes: a first supporting rod rotatably mounted to the wall-hung plate between the unfolded position and the folded position; and a second supporting rod rotatably mounted to the first supporting rod between a protruding position where the second supporting rod protrudes and a retracting position where the second supporting rod retracts.

In an embodiment of the present invention, the wall-hung plate is provided with a hook, the first supporting rod is provided with a first rotating shaft, and the first rotating shaft is rotatably fitted with the hook.

In an embodiment of the present invention, the wall-hung plate is provided with a folded positioning clasp, a first supporting plate is provided with a folded positioning boss, and the folded positioning clasp is snap-fitted over the folded positioning boss when the first supporting rod is in the folded position.

In an embodiment of the present invention, the first supporting rod is provided with a shaft hole, the second supporting rod is provided with a second rotating shaft, and the second rotating shaft is rotatably fitted in the shaft hole.

In an embodiment of the present invention, a guide ramp is disposed at an end face of an end of the second rotating shaft away from the second supporting rod.

In an embodiment of the present invention, the first supporting rod is provided with a retracting positioning boss, the second supporting rod is provided with a retracting positioning groove, and the retracting positioning boss is snap-fitted in the retracting positioning groove when the second supporting rod is in the retracting position.

In an embodiment of the present invention, the first supporting rod is provided with a protrusion positioning boss, the second supporting rod is provided with a protrusion positioning groove, and the protrusion positioning boss is snap-fitted in the protrusion positioning groove when the second supporting rod is in the protruding position.

In an embodiment of the present invention, the second supporting rod is provided with a handle that facilitates the rotation of the second supporting rod from the retracting position to the protruding position.

In an embodiment of the present invention, the second supporting rod is provided with a bearing shoulder, and the bearing shoulder abuts against the first supporting rod when the second supporting rod is in the protruding position.

In an embodiment of the present invention, a rear surface of the housing is provided with a supporting groove that is provided with a plurality of supporting ribs spaced apart from one another, when the supporting rod is in the unfolded position, the supporting rod is fitted in the supporting groove and supported on the plurality of supporting ribs.

Figure 1:
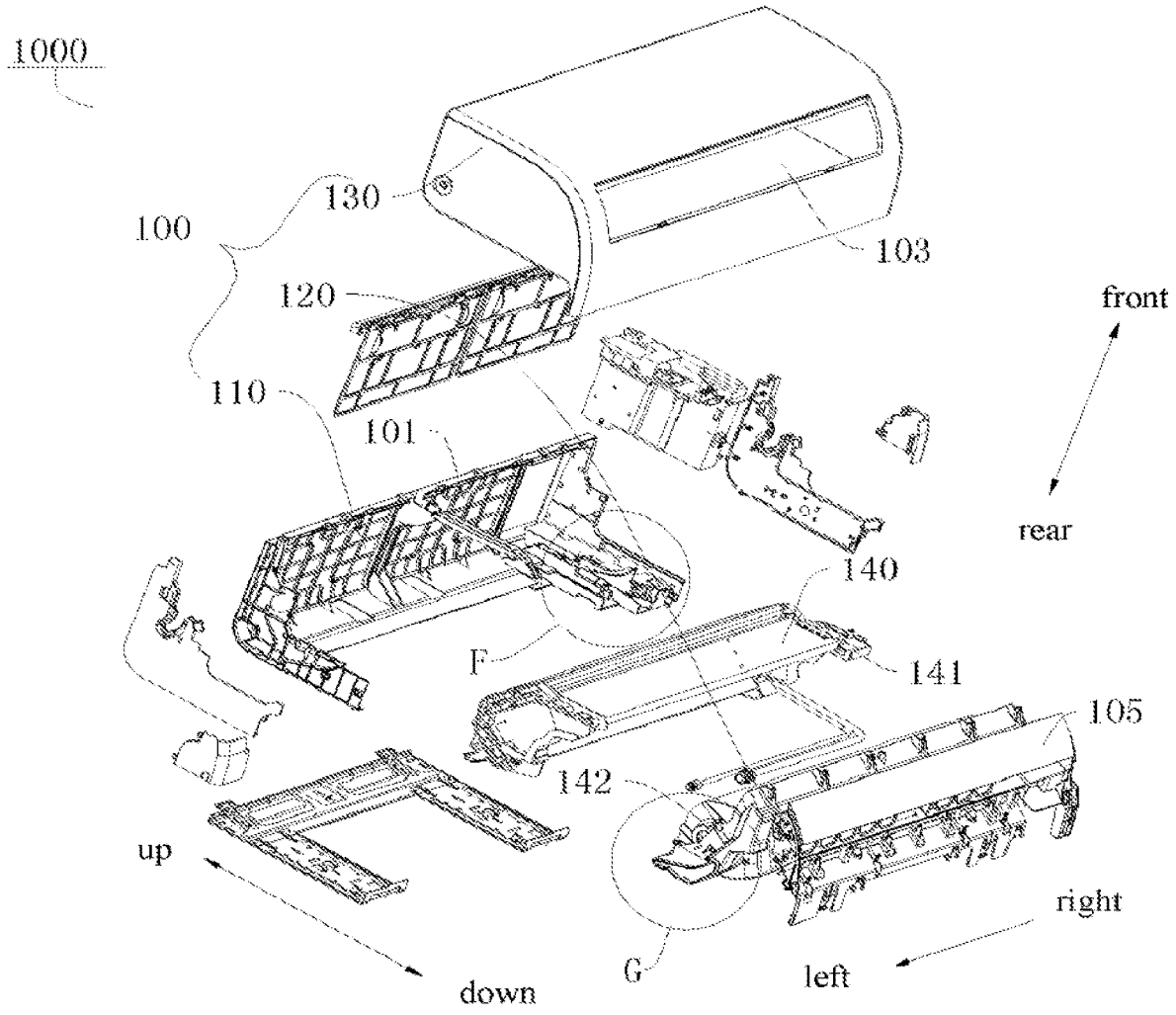
FIG. 1 is an exploded view of an indoor unit of an air conditioner in a direction according to an embodiment of the present invention.

REFERENCE NUMERALS indoor unit 1000 of air conditioner, housing 100, air inlet 101, air supply port 103, covering chamber 104, air deflector 105, supporting groove 106, supporting rib 107, upper base plate 110, rear baffle 111, upper cover plate 112, left end plate 113, right end plate 114, left shield plate 115, right shield plate 116, air inlet grille 117, lower base plate 120, front cover 130, front panel 131, lower panel 132, left panel 133, right panel 134, heat exchanger 140, water receiving cover 141, fan 142, fan wheel 143, motor 144, wall-hung plate 146, hook 146*a*, folded positioning clasp 146*b*, turn-up 146*c*, supporting rod 300, first supporting rod 310, first rotating shaft 311, folded positioning boss 312, shaft hole 313, retracting positioning boss 314, protrusion positioning boss 315, second supporting rod 320, second rotating shaft 321, guide ramp 322, retracting positioning groove 323, protrusion positioning groove 324, handle 325, bearing shoulder 326, thrust structure 340, body 350, thrust face 351, stopping ramp 352, recess 353, processing groove 354, pivot 360, resilient arm 370, free end 371, thrust protrusion 380, mounting rib 390, pivot hole 391, mounting space 392, guide groove 11, guide rail 12, limiting groove 14, connecting groove 15.

DETAILED DESCRIPTION

Embodiments of the present invention will be described in detail and examples of the embodiments will be illustrated in the drawings, where same or similar reference numerals are used to indicate same or similar members or members with same or similar functions. The embodiments described herein with reference to drawings are explanatory, which are used to illustrate the present invention, but shall not be construed to limit the present invention.

Figure 2:
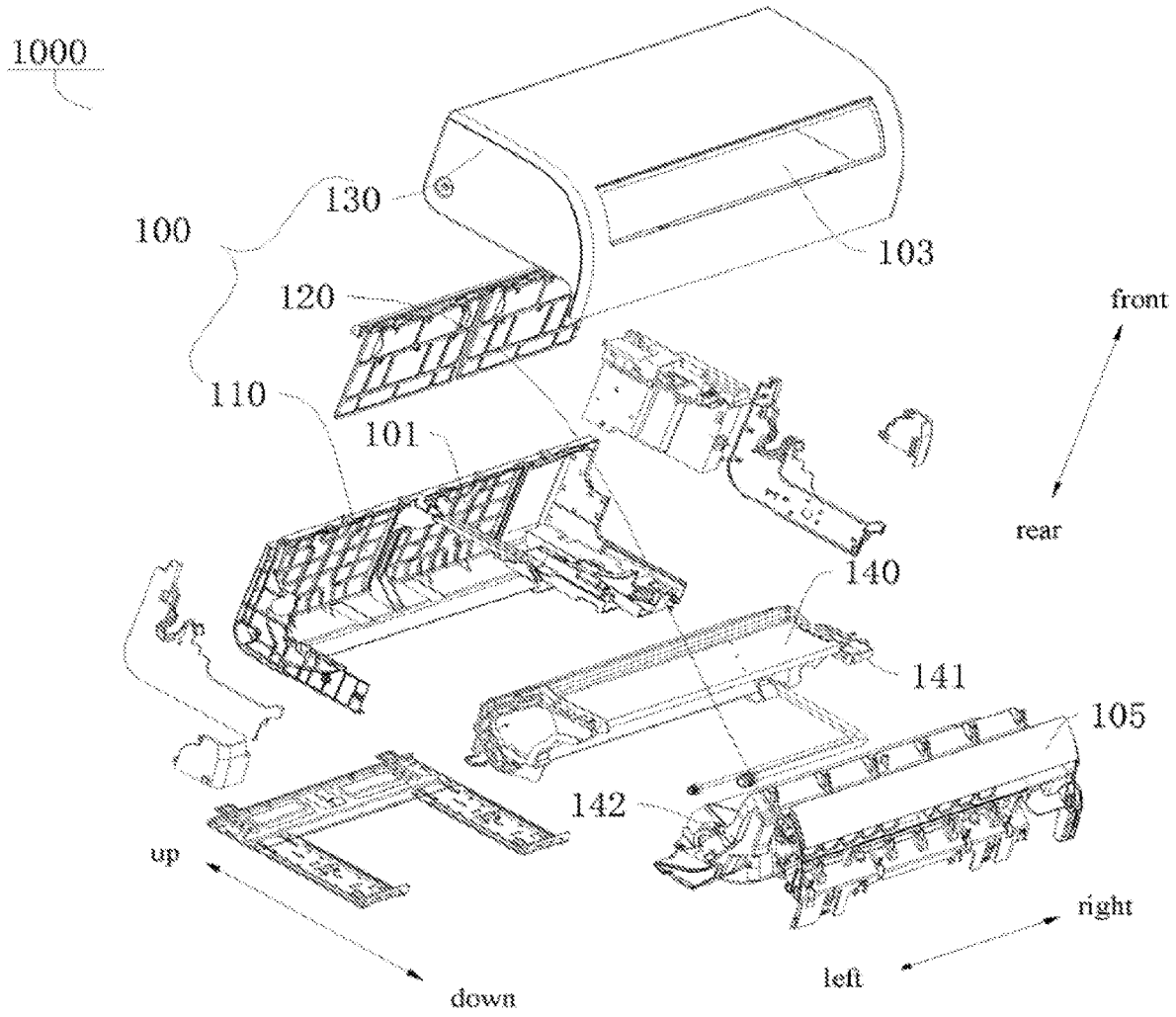
FIG. 2 is an exploded view of an indoor unit of an air conditioner in another direction according to an embodiment of the present invention.

As shown in FIGS. 1 and 2, an indoor unit 1000 of an air conditioner according to embodiments of the present invention includes a housing 1000, a heat exchanger 140 and a fan 142.

Specifically, the housing 100 includes an upper base plate 110, a lower base plate 120 detachably mounted to the upper base plate 110, and a front cover 130 detachably mounted to the upper base plate 110. The upper base plate 110 is provided with an air inlet 101 for air supply, and the lower base plate 120 is provided with an air outlet (not shown) for air exhaust. Driven by the fan 142, an air flow enters the indoor unit 1000 from the air inlet 101 and is sent out through the air outlet. The air flow exchanges heat with the heat exchanger 140 in the indoor unit 1000. The heat exchanger 140 is mounted to the upper base plate 110 and the fan 142 is detachably mounted to the lower base plate 120.

A thrust structure 340 of the indoor unit 1000 includes a body 350. The body 350 is disposed to a rear portion of the indoor unit 1000 and has a thrust face 351. The indoor unit is mounted on a wall via a mounting member. The thrust face 351 may abut against the mounting member to limit a degree of freedom of upward movement of the indoor unit 1000. Therefore, the thrust face 351 of the body 350 may abut against the mounting member to limit upward movement of the thrust structure 340, and the indoor unit 1000 connected with the thrust structure 340 cannot move upwards with respect to the mounting member. That is, the degree of freedom of the upward movement of the indoor unit 1000 is restricted. In such a way, the indoor unit 1000 will not be detached from the mounting member easily under a slight upward force, and hence be mounted more firmly and reliably, which ensures that the indoor unit 1000 will not be detached from the mounting member easily during later cleaning and repair.

In the indoor unit 1000 according to embodiments of the present invention, the fan 142 is mounted to the lower base plate 120 and the lower base plate 120 is detachably mounted to the upper base plate 110, such that the cleaning, maintenance and repair of the fan 142 just need to disassemble the lower base plate 120 from the upper base plate 110, and hence the fan 142 can be disassembled from the indoor unit 1000, which avoids the problem in the prior art that the heat exchanger 140 affects the assembling and dissembling of the fan 142. The convenient dismounting of the fan 142 in the present invention facilitates cleaning a fan wheel 143 of the fan 142. Moreover, the cleaning of the fan wheel 143 does not involve the dismounting and mounting of the heat exchanger 140, which avoids the problem that the heat exchanger 140 tends to break down due to the dismounting and mounting thereof, thus facilitating the maintenance of the indoor unit 1000 and reducing the failure rate of the indoor unit 1000.

Figure 3:
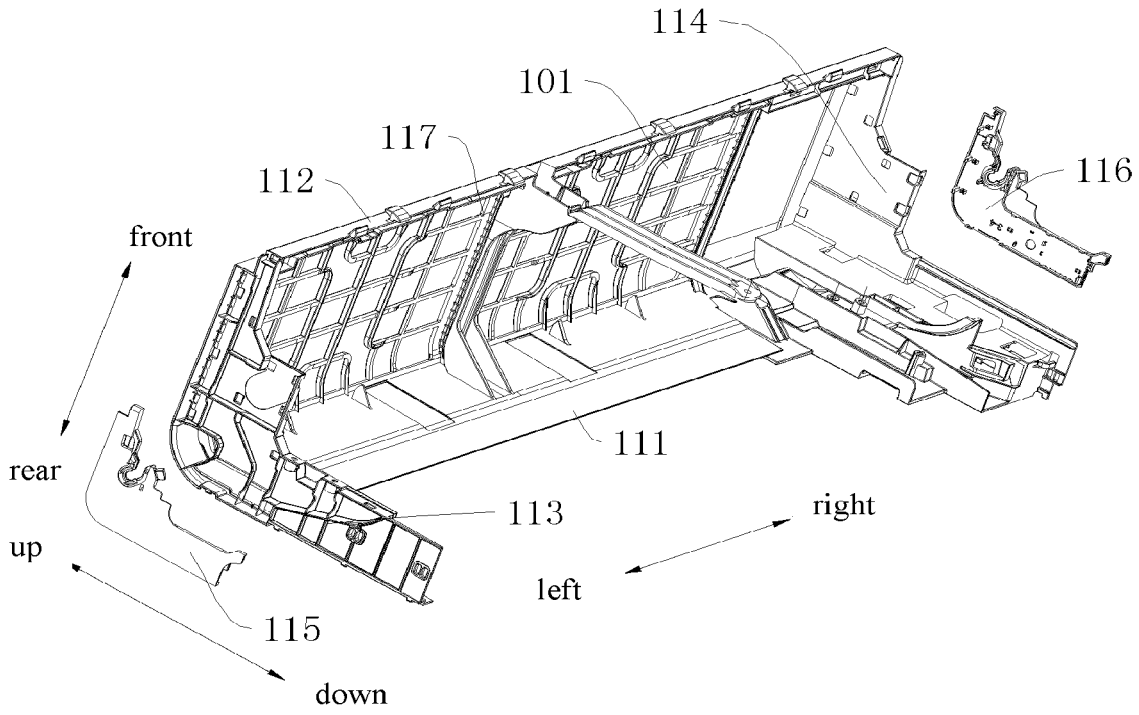
FIG. 3 is a schematic view of an upper base plate of an indoor unit of an air conditioner according to an embodiment of the present invention.

With reference to FIGS. 1 to 3, in some embodiments of the present invention, the upper base plate 110 includes: a rear baffle 111, an upper cover plate 112, a left end plate 113 and a right end plate 114. The heat exchanger 140 is mounted to the rear baffle 111. A rear edge of the upper cover plate 112 is connected with an upper edge of the rear baffle 111, and the air inlet 101 is formed in the upper cover plate 112, such that the air flow may enter the indoor unit 1000 from the air inlet 101 to exchange heat. The left end plate 113 has a rear edge connected with a left edge of the rear baffle 111 and an upper edge connected with a left edge of the upper cover plate 112. The right end plate 114 has a rear edge connected with a right edge of the rear baffle 111 and an upper edge connected with a right edge of the upper cover plate 112. Thus, the structural strength of the upper base plate 110 is improved and it is convenient to mount the heat exchanger 140 to the upper base plate 110, thereby improving the structural strength of the whole indoor unit 1000.

Additionally, by providing the air inlet 101 in the upper cover plate 112 of the upper base plate 110 and mounting the heat exchanger 140 to the rear baffle 111, a gap may be formed between the heat exchanger 140 and the upper cover plate 112 provided with the air inlet 101, such that the air flow may enter the indoor unit 1000 smoothly, to guarantee the smooth circulation of the air flow and improve the working efficiency of the indoor unit 1000.

Preferably, the lower base plate 120 is detachably mounted to the left end plate 113 and the rear baffle 111. The left end plate 113 is located at the left side of the lower base plate 120, and the right end plate 114 is located at the right side of the lower base plate 120, to facilitate mounting the lower base plate 120 to the upper base plate 110 and disassembling the lower base plate 120.

Further, with reference to FIGS. 1 to 3, the upper base plate 110 further includes a left shield plate 115 and a right shield plate 116. The left shield plate 115 is mounted at a left side face of the left end plate 113, and the right shield plate 116 is mounted at a right side face of the right end plate 114, so as to further improve the structural strength of the upper base plate 110 via the left shield plate 115 and the right shield plate 116 and also to enhance the sealing performance of the left and right sides of the upper base plate 110, along with a beautiful appearance of the housing 100.

Preferably, the front cover 130 is detachably mounted to the left shield plate 115 and the right shield plate 116, which facilitates mounting the front cover 130 and improves the efficiency of assembling and maintaining the indoor unit 1000.

Advantageously, as shown in FIG. 3, an air inlet grille 117 is provided at the air inlet 101 of the upper cover plate 112, which makes it convenient for the air flow to enter the indoor unit 1000 via the air inlet 101, and prevents dust from the outside from entering the indoor unit 1000 to a certain extent, thus reducing the amount of dust entering the indoor unit 1000, so as to facilitate cleaning the indoor unit 1000 and improve the stability and safety of the operation thereof.

Advantageously, the air inlet grille 117 is integrally formed in the upper cover plate 112, so as to improve the structural strength of the air inlet grille 117 and facilitate the molding of the upper cover plate 112.

Additionally, the upper base plate 110 according to the present invention may be configured as other forms of structures. For example, the upper base plate 110 may only include the rear baffle 111, but not the upper cover plate 112, as long as the rear baffle 111 is formed with positions where the heat exchanger 140 and the lower base plate 120 are mounted.

In some embodiments of the present invention, the front cover 130 is pivotably mounted over the upper base plate 110. That is, the front cover 130 is rotatably mounted to the upper base plate 110 between a first position where the housing 100, the heat exchanger 140 and the fan 142 are covered and a second position where the housing 100, the heat exchanger 140 and the fan 142 are exposed, so as to facilitate mounting the heat exchanger 140 and the fan 142 to the housing 100 and dismounting the heat exchanger 140 and the fan 142.

Figure 4:
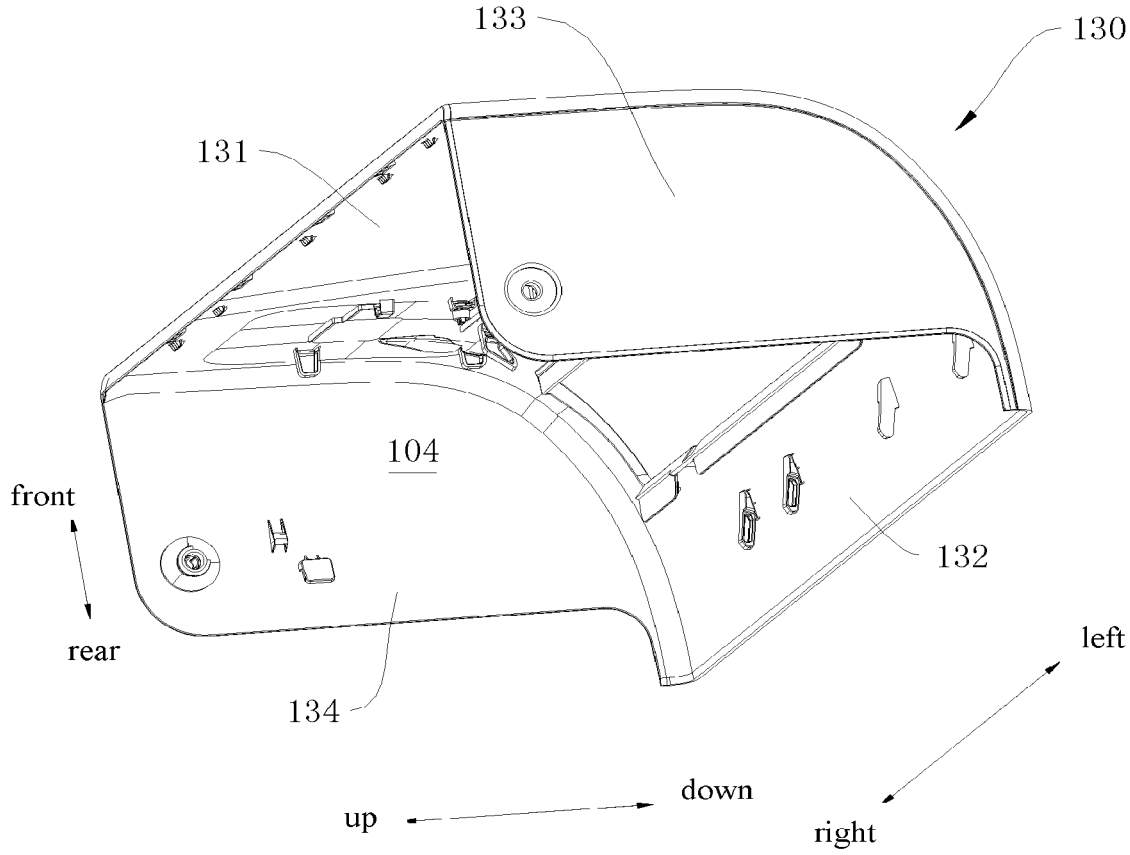
FIG. 4 is a schematic view of a front cover of an indoor unit of an air conditioner according to an embodiment of the present invention.

Referring to FIGS. 1, 2 and 4, in some embodiments of the present invention, the front cover 130 defines a covering chamber 104, and the upper base plate 110 and the lower base plate 120 are disposed in the covering chamber 104 and covered by the front cover 130, such that the indoor unit 1000 has a beautiful appearance and is closed, thus facilitating an oriented air supply. Alternatively, an air supply port 103 corresponding to the air outlet is provided in the front cover 130 and configured to avoid the air outlet.

Further, with reference to FIGS. 1, 2 and 4, the front cover 130 includes a front panel 131, a lower panel 132, a left panel 133 and a right panel 134. The front panel 131 covers front surfaces of the upper base plate 110 and the lower base plate 120. The lower panel 132 has a front edge connected with a lower edge of the front panel 131, and covers a lower surface of the lower base plate 120, in which the air supply port 103 is provided at a position where the front panel 131 and the lower panel 132 are connected. The left panel 133 has a front edge connected with a left edge of the front panel 131 and a lower edge connected with a left edge of the lower panel 132, and is rotatably mounted to a left side face of the upper base plate 110 and covers the left side face thereof. The right panel 134 has a front edge connected with a right edge of the front panel 131 and a lower edge connected with a right edge of the lower panel 132, and is rotatably mounted to a right side face of the upper base plate 110 and covers the right side face thereof.

Further, with reference to FIG. 1, the left panel 133 is provided at the left side of the upper base plate 110, and the right panel 134 is provided at the right side thereof, A rotating shaft is provided at each of a rear end of an upper portion of each of the left panel 133 and the right panel 134, while a shaft hole fitted with the rotating shaft is provided in each of the left shield plate 115 and the right shield plate 116 of the upper base plate 110, so as to realize the rotatable mounting of the front cover 130 to the housing 100 via the fitting between the shaft and hole.

Advantageously, the front panel 131 and the lower panel 132 are connected via an arc transition portion, to make the appearance of the indoor unit 100 aesthetic. Moreover, the rounded-off surface is less easy to damage than an angular surface during the transportation of the indoor unit 1000.

Additionally, the front panel 131 and the lower panel 132 of the front cover 130 may be molded separately, in which the lower panel 132 may be individually fixed to the lower panel 120 or integrally molded with the lower panel 120.

Figure 5:
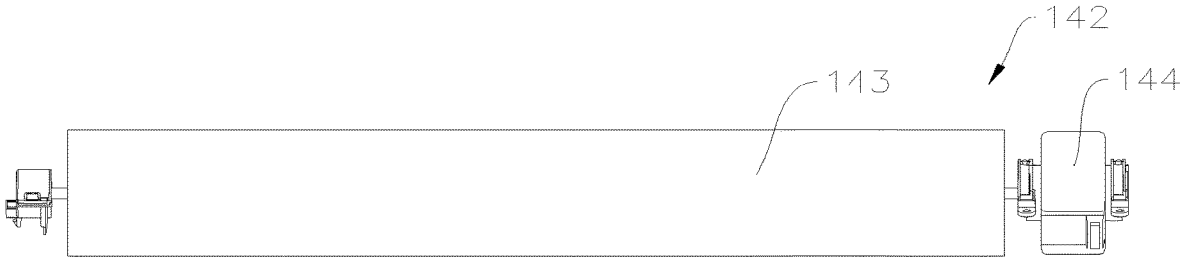
FIG. 5 is a schematic view of a fan of an indoor unit of an air conditioner according to an embodiment of the present invention.

As shown in FIG. 5, in some embodiments of the present invention, the fan 142 includes a fan wheel 143 and a motor 144. The fan wheel 143 is detachably mounted to the lower base plate 120; and the motor 144 is detachably mounted to the lower base plate 120 and connected with the fan wheel 143 in a transmission way, so as to facilitate the operation, mounting and dismounting of the fan 142.

Further, the lower base plate 120 is provided with a motor mounting groove (not shown); the upper base plate 110 is provided with a water receiving cover 141; the motor 144 is mounted in the motor mounting groove; and the water receiving cover 141 is located below the heat exchanger 140 and presses the motor 144 in the motor mounting groove.

In some embodiments of the present invention, an air deflector 105 is provided at the air outlet and exposed from the air supply port of the lower base plate 120, to guide the direction of the air flow sent out from the indoor unit 1000.

The present invention further discloses the housing 100 of the indoor unit 1000. The housing 100 includes the lower base plate 120, the upper base plate 110 and the front cover 130. The lower base plate 120 is provided with the air outlet and a fan mounting structure (not shown) for mounting the fan 142. The upper base plate 110 is detachably mounted to the lower base plate 120, and provided with the air inlet 101 and a heat exchanger mounting structure for mounting the heat exchanger 140. The front cover 130 is detachably mounted to the upper base plate 110 and provided with an air supply port 103 in a position corresponding to that of the air outlet.

In the housing 100 of the indoor unit 1000 according to embodiments of the present invention, the fan 142 and the heat exchanger 140 may be mounted or dismounted, and cleaned conveniently by mounting the fan 142 to the lower base plate 120 via the fan mounting structure and mounting the heat exchanger 140 to the upper base plate 110 via the heat exchanger mounting structure.

In the present invention, the upper base plate 110 is provided to mount the heat exchanger 140 thereto, and the lower base plate 120 is provided to mount the fan 142 thereto. The lower base plate 120 and the fan 142 are mounted below the upper base plate 110 and the heat exchanger 140, such that the dismounting of the fan 142 only needs to dismount the lower base plate 120 located below from the upper base plate 110, which may separate the fan 142 from a main body of the indoor unit 1000 and also facilitate the maintenance and cleaning of the fan 142. The procedure of cleaning the fan 142 of the indoor unit 1000 is simplified, so that even the user may clean the fan on his own.

In addition, the front cover 130 is configured to be pivotably connected with the upper base plate 110. The process of dismounting and mounting the fan 142 does not need to dismount the front cover 130 (or the front cover 130 may be dismounted very easily), which further facilitates the maintenance of the fan 142 of the indoor unit 1000.

Figure 6:
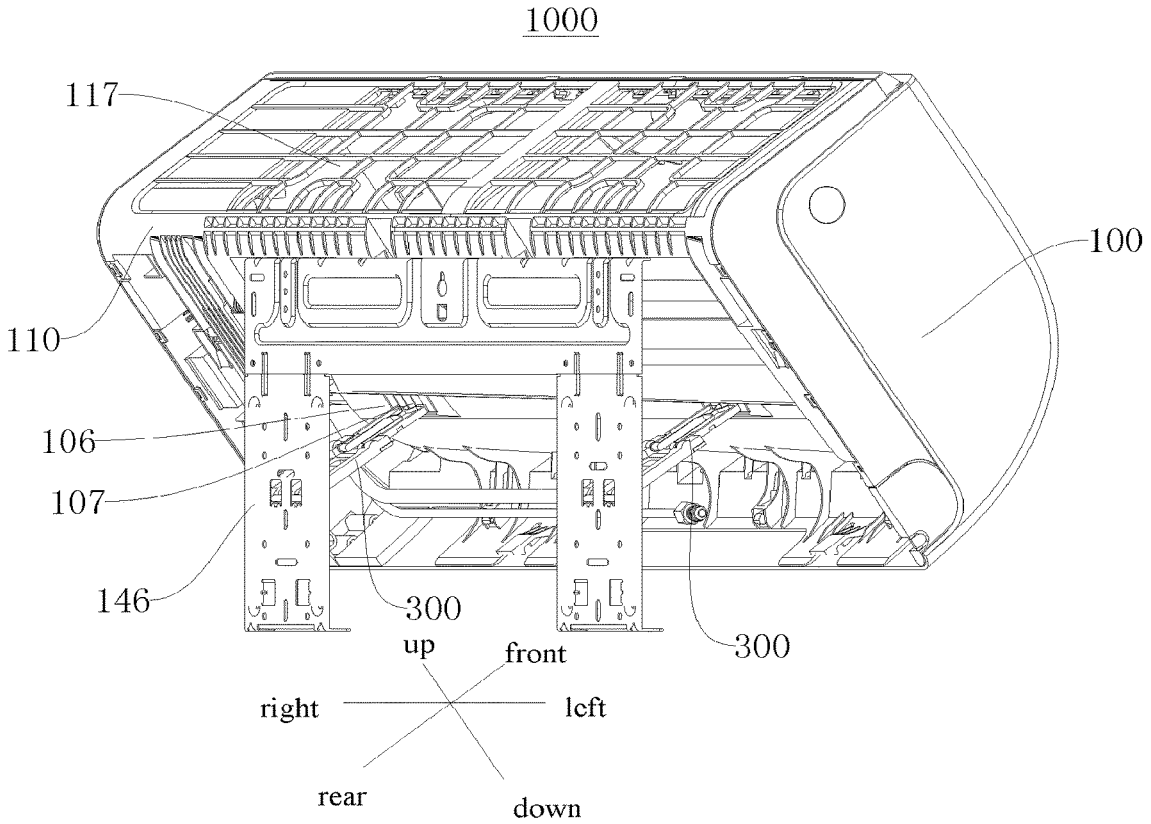
FIG. 6 is a schematic view of an indoor unit of an air conditioner according to an embodiment of the present invention, in which a supporting rod is in an unfolded position.
Figure 7:
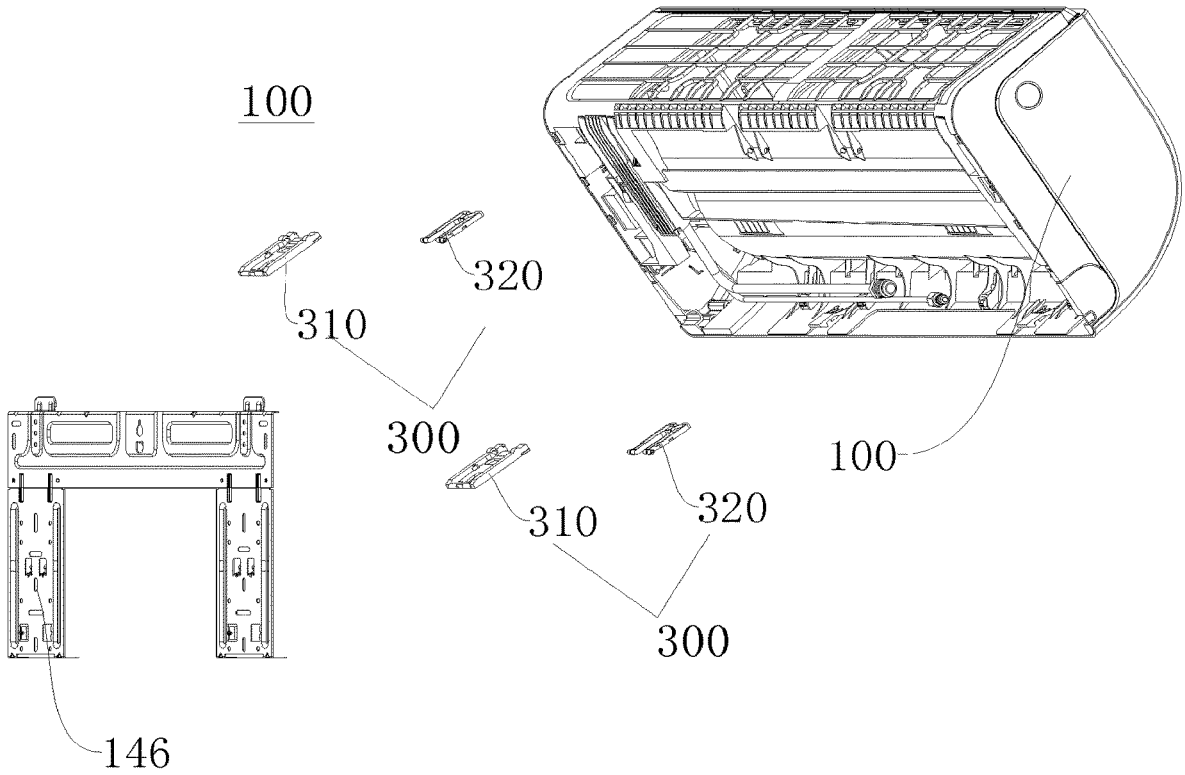
FIG. 7 is an exploded view of an indoor unit of an air conditioner according to an embodiment of the present invention.

As shown in FIG. 6, the housing 100 is hung on a wall-hung plate 146 that is mounted on the wall. A supporting rod 300 is rotatably mounted to the wall-hung plate 146 between an unfolded position where a lower portion for supporting the housing 100 of the supporting rod 300 is away from the wall-hung plate 146 and a folded position where the supporting rod 300 abuts against the wall-hung plate 146. However, the present invention is not limited thereby. In an embodiment not shown in the present invention, the supporting rod 300 is rotatably mounted to the housing 100 between an unfolded position where the lower portion for supporting the housing 100 of the supporting rod 300 is away from the wall-hung plate 146 and a folded position where the supporting rod 300 abuts against the housing 100. However, the present invention is not limited thereby. In an embodiment not shown in the present invention, the supporting rod 300 is rotatably mounted to the housing 100 between an unfolded position where the lower portion for supporting the housing 100 of the supporting rod 300 is away from the wall-hung plate 146 and a folded position where the supporting rod 300 abuts against the supporting housing 100.

FIG. 6 shows the indoor unit 1000, in which the supporting rod 300 is in the unfolded position. Since the housing 100 is hung on the wall-hung plate 146 via an upper member, the lower portion of the housing 100 moves away from the wall-hung plate 146 under the action of the supporting rod 300, as shown in FIG. 6, and the supporting rod 300 props up a triangular area between the wall-hung plate 146 and the housing 100. In a state shown in FIG. 10, the wall-hung plate 146 and the supporting rod 300 are displayed, i.e. the supporting rod 300 is in the folded position, and the supporting rod 300 abuts against the wall-hung plate 146.

It should be understood that the air conditioner may include the indoor unit 1000 and an outdoor unit, and the indoor unit 1000 and the outdoor unit are connected via a connecting pipe. Normally, the connecting pipe is pre-embedded in the wall, and when the indoor unit 1000 is assembled with the connecting pipe, a rear side of the indoor unit 1000 needs to be propped up to complete the assembling.

Accordingly, in the indoor unit 1000 according to the embodiments of the present invention, the supporting rod 300 is provided to prop up the lower portion of the housing 100 and the wall-hung plate 146 to from an operable area, so as to facilitate assembling the indoor unit 1000 and the connecting pipe and improve the efficiency of assembling the indoor unit 1000, thereby further facilitating the maintenance of the indoor unit 1000. Additionally, the supporting rod 300 may abut against the wall-hung plate 146 or the housing 100 when in the folded position, which does not occupy the space of the indoor unit 1000 and thus improving the space utilization rate of the indoor unit 1000.

Figure 8:
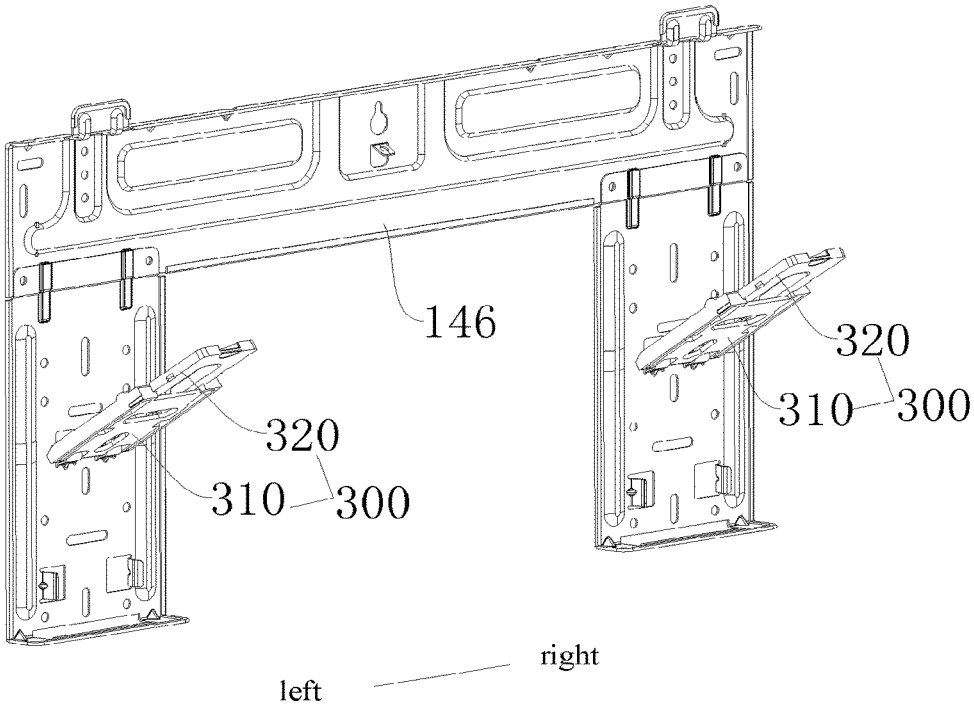
FIG. 8 is a schematic view of a wall-hung plate and a supporting rod of an indoor unit of an air conditioner according to an embodiment of the present invention, in which the supporting rod is in an unfolded position.
Figure 9:
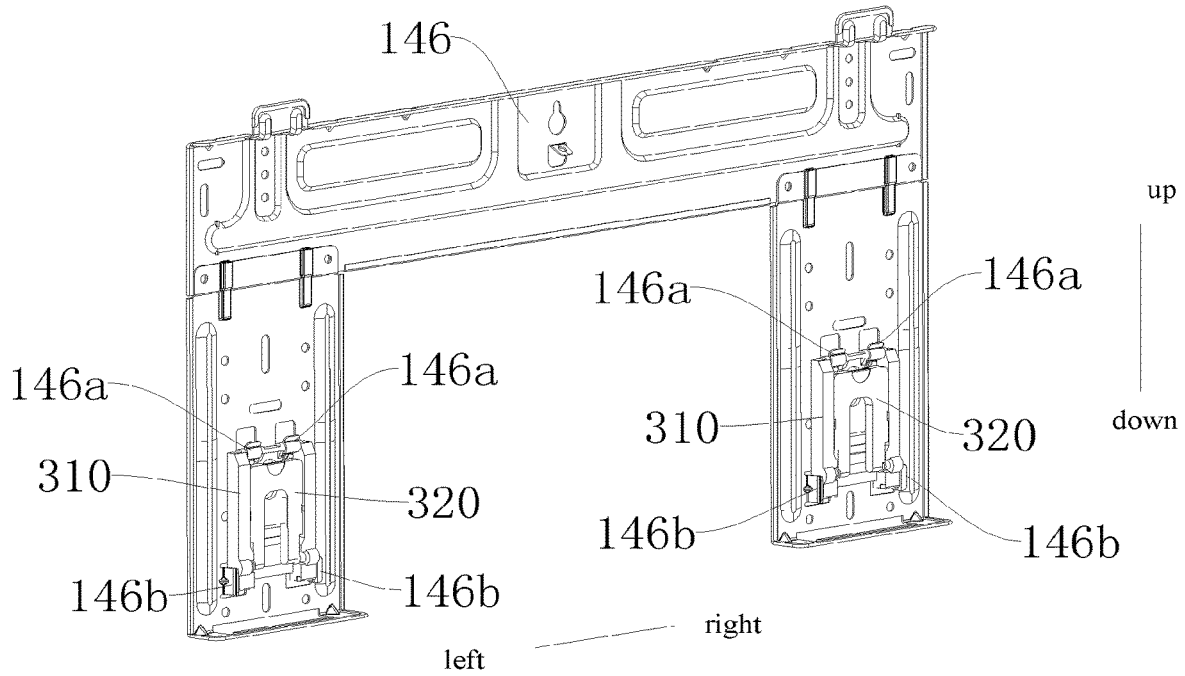
FIG. 9 is a schematic view of the wall-hung plate and the supporting rod of the indoor unit of the air conditioner according to the embodiment of the present invention, in which the supporting rod is in a folded position.

In some examples of the present invention, the supporting rod 300 may include a first supporting rod 310 and a second supporting rod 320. The first supporting rod 310 is rotatably mounted to the wall-hung plate 146 between the unfolded position and the folded position; and the second supporting rod 320 is rotatably mounted to the first supporting rod 310 between a protruding position where the second supporting rod 320 protrudes and a retracting position where the second supporting rod 320 retracts. As shown in FIG. 8, when the first supporting rod 310 is in the unfolded position and the second supporting rod 320 is in the protruding position, the first supporting rod 310 and the second supporting rod 320 may prop up the wall-hung plate 146 and the housing 100 to form an operable area. As shown in FIG. 9, when the first supporting rod 310 is in the folded position and the second supporting rod 320 is in the retracting position, the first supporting rod 310 abuts against the wall-hung plate 146 and the second supporting rod 320 abuts against the first supporting rod 310.

Figure 10:
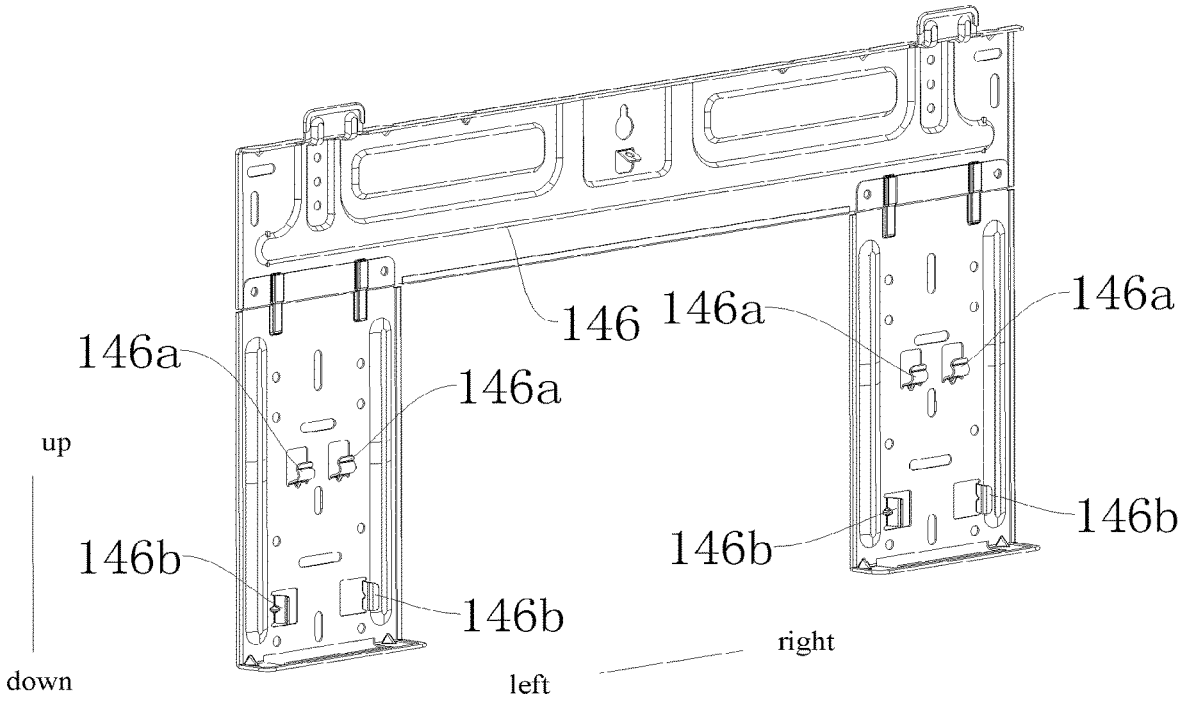
FIG. 10 is a schematic view of the wall-hung plate of the indoor unit of the air conditioner according to the embodiment of the present invention.
Figure 13:
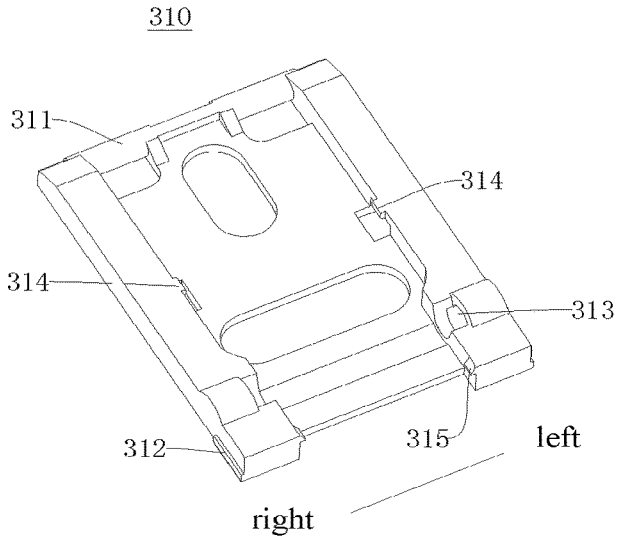
FIG. 13 is a schematic view of a first supporting rod of the indoor unit of the air conditioner according to the embodiment of the present invention.

Specifically, with reference to FIGS. 10 and 13, the wall-hung plate 146 may be provided with a hook 146*a*, the first supporting rod 310 is provided with a first rotating shaft 311, and the first rotating shaft 311 is rotatably fitted with the hook 146*a*. As shown in FIG. 10, two hooks 146*a* are provided, and the first rotating shaft 311 is mounted in the two hooks 146*a*. However, the present invention is not limited thereby—the first rotating shaft 311 may be mounted to the wall-hung plate 146 via a snap structure.

Figure 11:
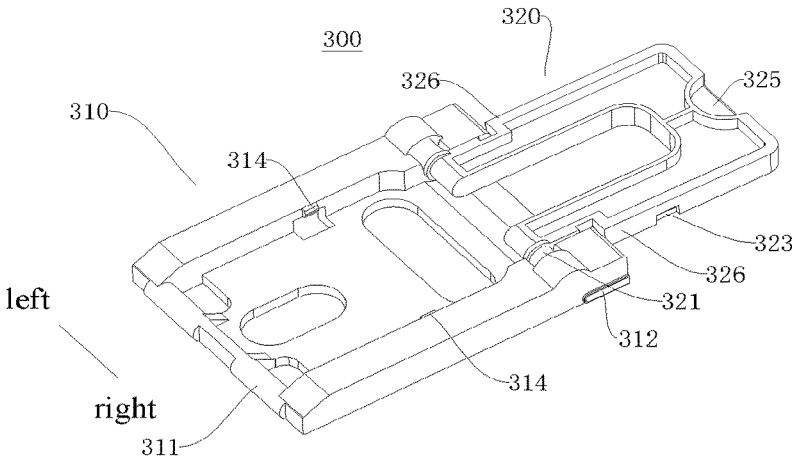
FIG. 11 is a schematic view of the supporting rod of the indoor unit of the air conditioner according to the embodiment of the present invention, in which the supporting rod is in the unfolded position.
Figure 12:
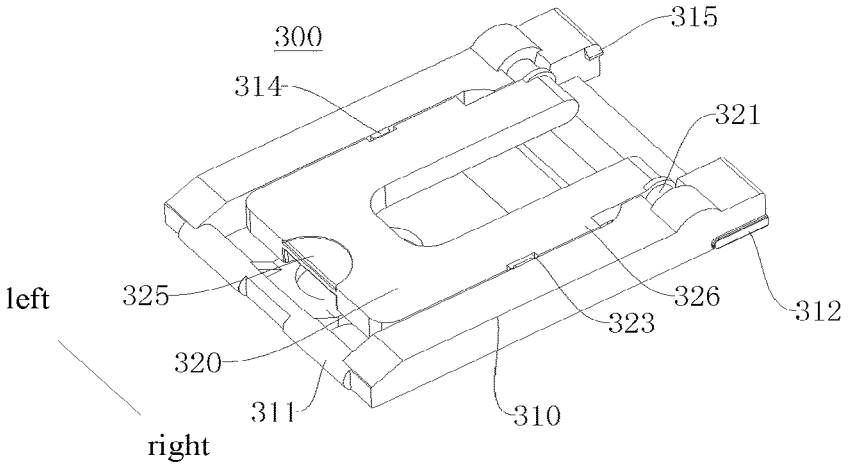
FIG. 12 is a schematic view of the supporting rod of the indoor unit of the air conditioner according to the embodiment of the present invention, in which the supporting rod is in the folded position.
Figure 14:
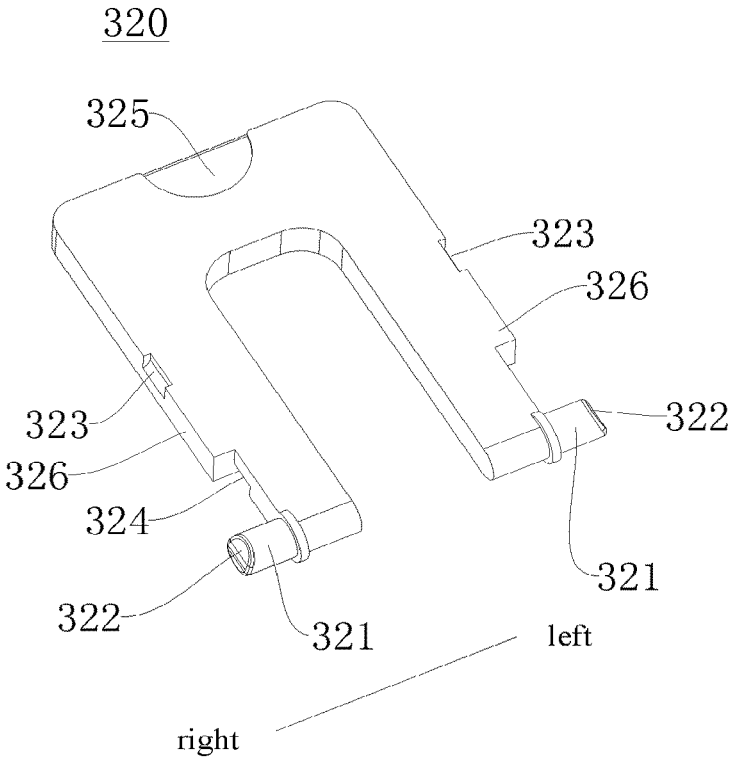
FIG. 14 is a schematic view of a second supporting rod of the indoor unit of the air conditioner according to the embodiment of the present invention.

With reference to FIGS. 11, 12 and 14, the first supporting rod 310 may be provided with a shaft hole 313, the second supporting rod 320 is provided with a second rotating shaft 321, and the second rotating shaft 321 is rotatably fitted in the shaft hole 313. That is, the first supporting rod 310 is rotatably mounted to the wall-hung plate 146, and the second supporting rod 320 is rotatably mounted to the first supporting rod 310. For example, as shown in FIG. 13, the first rotating shaft 311 and the shaft hole 313 of the first supporting rod 310 are remote from each other, such that when the supporting rod 300 is in the unfolded position, the first supporting rod 310 may have a relatively great extended length and hence the operable area propped by the supporting rod 300 will be relatively large.

Alternatively, the wall-hung plate 146 may be provided with a folded positioning clasp 146*b*, a first supporting plate may be provided with a folded positioning boss 312, and the folded positioning clasp 146*b* is snap-fitted over the folded positioning boss 312 when the first supporting rod 310 is in the folded position. As shown in FIGS. 9, 10 and 11, the folded positioning boss 312 is disposed at each side of the first supporting rod 310, and the wall-hung plate 146 is provided with folded positioning clasps 146*b* corresponding to the folded positioning bosses 312 at two sides of the first supporting rod 310. When the first supporting rod 310 is in the folded position, the folded positioning clasps 146*b* at two sides of the first supporting rod 310 are snap-fitted over the corresponding folded positioning bosses 312. Alternatively, the folded positioning clasp 146*b* can be deformed resiliently. When the first supporting rod 310 moves from the unfolded position to the folded position, the folded positioning clasp 146*b* is deformed resiliently to be snap-fitted over the folded positioning boss 312 easily. Meanwhile, the folded positioning clasp 146*b* may be removed from the folded positioning boss 312 easily due to its resilient deformation.

Specifically, an end face of the second rotating shaft 321 away from the second supporting rod 320 may be provided with a guide ramp 322. As shown in FIG. 14, the second supporting rod 320 is provided with two second rotating shafts 321, in which the second rotating shaft 321 at a left side is provided with the guide ramp 322 at a left end face thereof, and the second rotating shaft 321 at a right side is provided with the guide ramp 322 at a right end face thereof. By providing the guide ramp 322, the first supporting rod 310 and the second supporting rod 320 may be assembled easily, which improves the assembling efficiency.

As an alternative embodiment, as shown in FIGS. 12 to 14, the first supporting rod 310 may be provided with a retracting positioning boss 314, and the second supporting rod 320 is provided with a retracting positioning groove 323. The retracting positioning boss 314 is snap-fitted in the retracting positioning groove 323, when the second supporting rod 320 is in the retracting position. Through the fitting between the retracting positioning boss 314 and the retracting positioning groove 323, the second supporting rod 320 may abut against the first supporting rod 310 closely, when the second supporting rod 320 is in the retracting position. Alternatively, the first supporting rod 310 may be provided with a plurality of the retracting positioning bosses 314, the second supporting rod 320 may be provided with a plurality of the retracting positioning grooves 323, and the plurality of the retracting positioning bosses 314 is fitted with the plurality of the retracting positioning grooves 323 in one-to-one correspondence.

In some specific examples of the present invention, as shown in FIGS. 11, 13 and 14, the first supporting rod 310 may be provided with a protrusion positioning boss 315, and the second supporting rod 320 may be provided with a protrusion positioning groove 324. The protrusion positioning boss 315 is snap-fitted in the protrusion positioning groove 324, when the second supporting rod 320 is in the protruding position. Through the fitting between the protrusion positioning boss 315 and the protrusion positioning groove 324, the second supporting rod 320 can be positioned firmly in the protruding position, thereby making the support of the supporting rod 300 reliable. Alternatively, the first supporting rod 310 may be disposed with a plurality of the protrusion positioning bosses 315, the second supporting rod 320 may be provided with a plurality of the protrusion positioning grooves 324, and the plurality of protrusion positioning bosses 315 is fitted with the plurality of protrusion positioning grooves 324 in one-to-one correspondence.

Alternatively, the second supporting rod 320 may be provided with a handle 325 that facilitates the rotation of the second supporting rod 320 from the retracting position to the protruding position. With reference to FIGS. 11 and 12, when the supporting rod 300 is in the folded position, an operator may pull the handle 325 of the second supporting rod 320 to make the second supporting rod 320 rotate with respect to the first supporting rod 310. After the second supporting rod 320 completes the rotation, the handle 325 can be pulled to make the first supporting rod 310 rotate with respect to the wall-hung plate 146. By providing the handle 325, the supporting rod 300 may be unfolded or folded conveniently.

Alternatively, the second supporting rod 320 may be provided with a bearing shoulder 326, and the bearing shoulder 326 abuts against the first supporting rod 310 when the second supporting rod 320 is in the protruding position. As shown in FIG. 11, when the second supporting rod 320 is in the protruding position, the bearing shoulder 326 abuts against the first supporting rod 310, which may improve the bearing capacity of the second supporting rod 320 and thus make the fitting between the first supporting rod 310 and the second supporting rod 320 stable.

As shown in FIG. 6, a rear surface of the housing 100 may be provided with a supporting groove 106, and the supporting groove 106 is provided with a plurality of supporting ribs 107 therein which is spaced apart from one another. When the supporting rod 300 is in the unfolded position, the supporting rod 300 is fitted in the supporting groove 106 and supported on the plurality of supporting ribs 107. That is, when the supporting rod 300 is in the unfolded position, the supporting rod 300 is supported on the plurality of supporting ribs 107. By providing the plurality of supporting ribs 107, the stability of fitting between the housing 100 and the supporting rod 300 can be improved.

Figure 15:
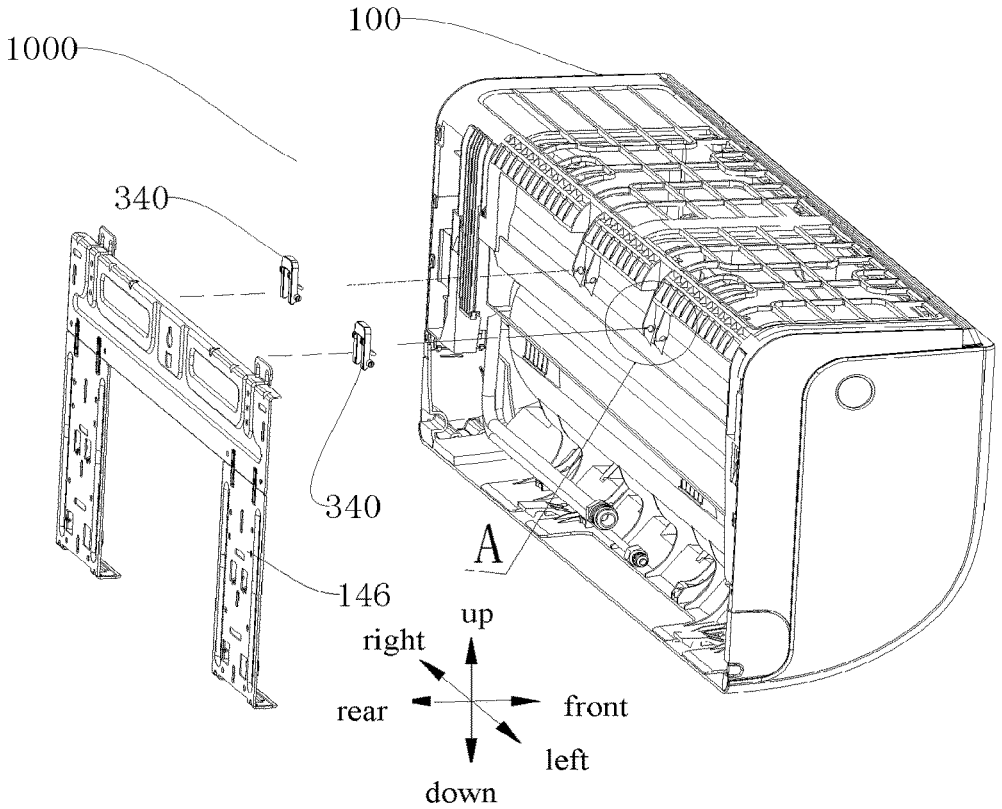
FIG. 15 is an exploded schematic view of an indoor unit of an air conditioner according to an embodiment of the present invention.
Figure 26:
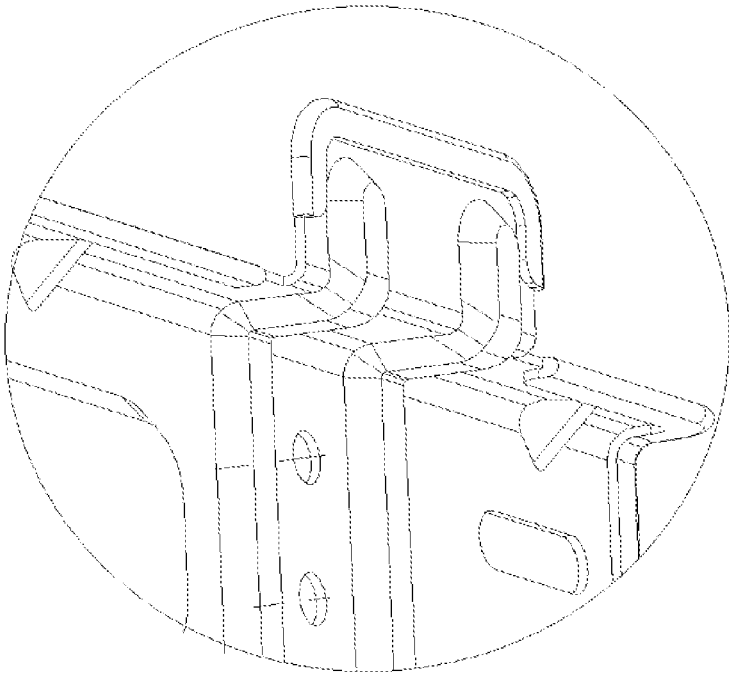
FIG. 26 is an enlarged view of part E in FIG. 25.

Referring to FIGS. 15 and 26, the thrust structure 340 of the indoor unit 1000 includes the body 350. The body 350 is disposed to the rear portion of the indoor unit 1000 and has the thrust face 351. The indoor unit is mounted on the wall via the mounting member. The thrust face 351 may abut against the mounting member to limit the degree of freedom of upward movement of the indoor unit 1000. Therefore, the thrust face 351 of the body 350 may abut against the mounting member to limit upward movement of the thrust structure 340, and thus the indoor unit 1000 connected with the thrust structure 340 cannot move upwards with respect to the mounting member. That is, the degree of freedom of the upward movement of the indoor unit 1000 is restricted. In such a way, the indoor unit 1000 will not be detached from the mounting member easily under a slight upward force, and hence be mounted more firmly and reliably, which ensures that the indoor unit 1000 will not be detached from the mounting member easily during later cleaning and repair.

It should be noted that the sentence that "the thrust face 351 may abut against the mounting member" should to be understood broadly. That is, it may mean that the thrust face 351 of the thrust structure 340 abuts against the mounting member when the indoor unit 1000 is mounted on the wall via the mounting member; or mean that there is a narrow gap between the thrust face 351 and the mounting member (i.e. the thrust face 351 does not abut against the mounting member) when the indoor unit 1000 is mounted on the wall via the mounting member, and the thrust face 351 is able to abut against the mounting member when the indoor unit 1000 moves upwards slightly under the upward force, in which the thrust face 351 still has the effect of stopping the upward movement of the indoor unit 1000.

In some embodiments of the present invention, an upper end face of the body 350 is configured as the thrust face 351. That is, after assembling the indoor unit 1000 and the mounting member, the upper end face of the body 350 may abut against the mounting member to limit the upward movement of the body 350 and the indoor unit 1000 with respect to the mounting member. This structure of the body 350 itself is used as the thrust face 351, which is designed reasonably, and needs no more extra components attached to the body 350 as the thrust face 351, thus providing a simple structure and convenient manufacturing and processing.

Figure 22:
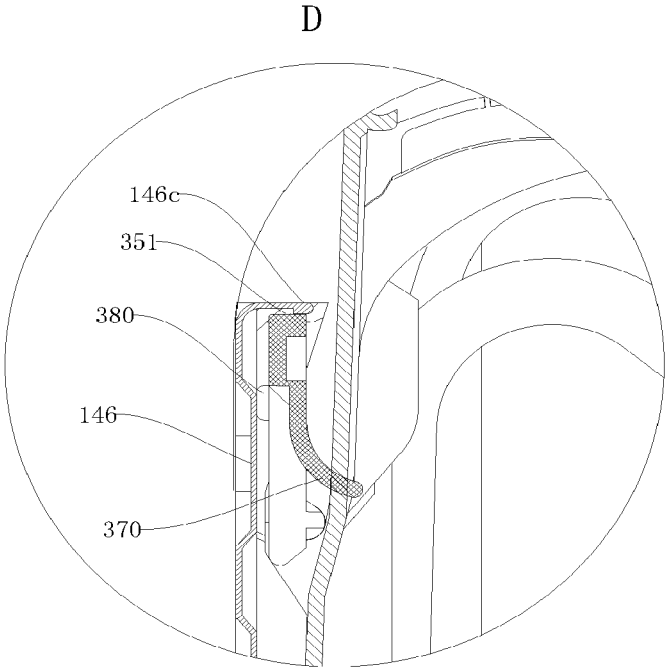
FIG. 22 is an enlarged view of part D in FIG. 21.
Figure 23:
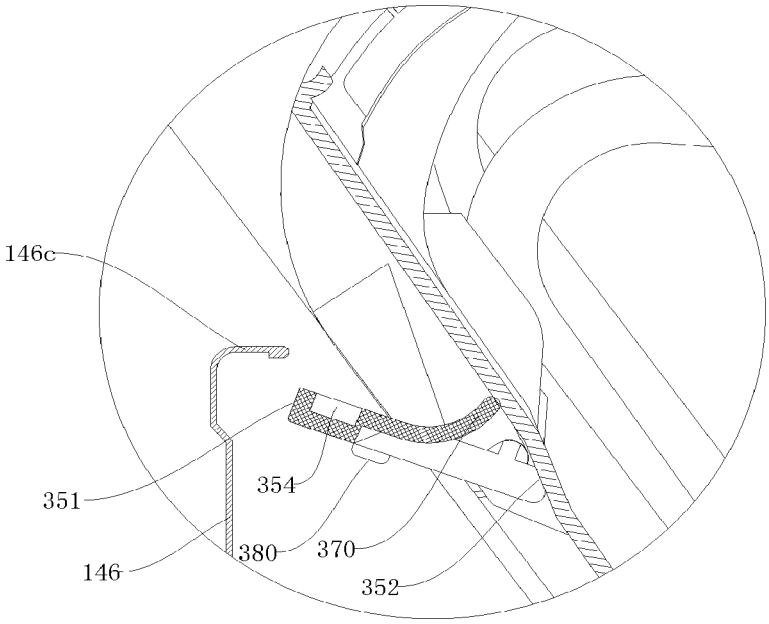
FIG. 23 is a schematic view of the structure in FIG. 22 when the thrust structure is separated from the wall-hung plate.
Figure 24:
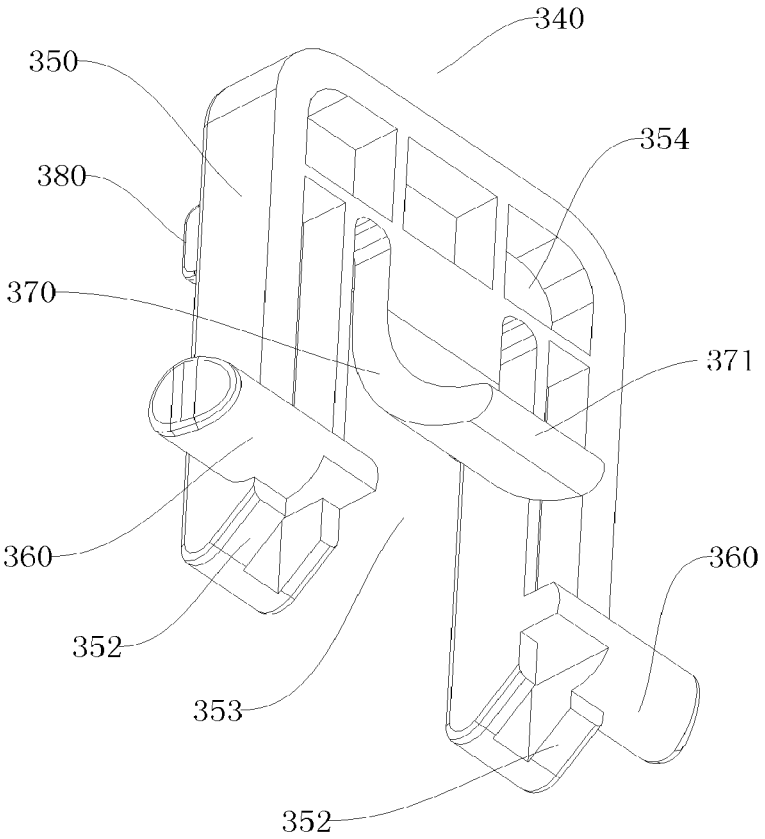
FIG. 24 is a schematic view of the thrust structure according to the embodiment of the present invention.
Figure 25:
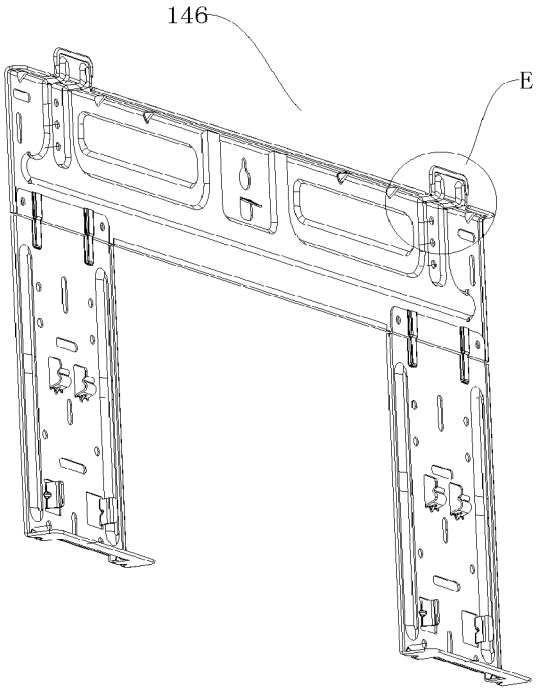
FIG. 25 is a schematic view of a wall-hung plate of an indoor unit of an air conditioner according to an embodiment of the present invention.

As shown in FIGS. 22 to 24, a lower end of the body 350 has a stopping ramp 352, and the body 350 is pivotably connected to the rear portion of the indoor unit 1000 between a first position and a second position. A pivot 360 may be provided at each of two sides of the body 350, and a pivot hole 391 may be provided in the indoor unit 1000 to be fitted with the pivot 360, such that the body 350 is pivotably connected to the indoor unit 1000.

Herein, the first position where the body 350 is refers to an open position of the thrust structure 340, in which the thrust structure 340 is assembled to the indoor unit 1000 but is not connected with the mounting member. That is, the body 350 is in a position without any external force, i.e. an initial position. The second position where the body 350 is refers to a stopping position of the thrust structure 340. That is, the thrust structure 340 is in a position where it has already been assembled with the indoor unit 1000 and the mounting member, i.e. a working position.

Specifically, when the body 350 is in the first position, the stopping ramp 352 abuts against a rear wall face of the indoor unit 1000 to make an upper end of the body 350 move rearwards, away from the rear wall face of the indoor unit 1000, and open. That is, the thrust face 351 of the body 350 moves rearwards and away from the rear wall face of the indoor unit 1000. At this moment, a certain angle exists between the body 350 and the indoor unit 1000, and the angle is determined by a degree of inclination of the stopping ramp 352.

For example, as shown in FIG. 22, the stopping ramp 352 is disposed at a lower portion of the body 350 and obliquely extends forwards and upwards. When the stopping ramp 352 abuts against the rear portion of the indoor unit 1000, the body 350 may be configured to obliquely extend rearwards and upwards, in which case the body 350 and the indoor unit 1000 forms an acute angle therebetween, and this structure is convenient to assemble or disassemble.

Further, when the body 350 is in the second position, the body 350 is vertically oriented, i.e. the body 350 is configured to extend along a vertical direction. The stopping ramp 352 is separated from the rear portion of the indoor unit 1000, i.e. the stopping ramp 352 no longer abuts against the rear portion of the indoor unit 1000. In such a case, the thrust face 351 abuts upwards against the mounting member to limit the degree of freedom of the upward movement of the indoor unit 1000, i.e. the thrust structure 340 plays a role in thrusting.

As shown in FIGS. 21 to 24, the body 350 is provided with a resilient arm 370 extending forwards and downwards, and a free end 371 of the resilient arm 370 normally abuts against the rear portion of the indoor unit 1000. That is, when the thrust structure 340 is assembled to the indoor unit 1000, the free end 371 of the resilient arm 370 keeps abutting against the rear portion of the indoor unit 1000. Herein, the free end 371 of the resilient arm 370 refers to an end of the resilient arm 370 extending forwards and downwards.

Specifically, when the body 350 is located in the first position or the second position, or pivots between the first position and the second position, the free end 371 of the resilient arm 370 keeps abutting against the rear portion of the indoor unit 1000. An abutting force between the resilient arm 370 and the indoor unit 1000 secures the connection between the indoor unit 1000 and the thrust structure 340. Meanwhile, the thrust structure 340 has a tendency to move towards the open position. When the mounting member is separated from the thrust structure 340, the thrust structure 340 may return to the open position automatically under the abutting force, without any manual operation, so as to facilitate taking out the thrust structure 340.

As shown in FIG. 24, in some embodiments of the present invention, the body 350 may be substantially configured as an inverted U-shaped structure with a recess 353 opening downwards. The resilient arm 370 is disposed in the recess 353, or the resilient arm 370 is formed by separating a structure originally at the recess 353 from the body 350 and moving the structure forwards. The recess 353 can provide space for deformation of the resilient arm 370 to make the deformation of the resilient arm 370 smooth, as well as make the pivot of the thrust structure 340 and the indoor unit 1000 smooth. This structure is designed reasonably and is easy to manufacture. Preferably, the resilient arm 370 may be configured as an arc plate which has better deformability and aesthetic appearance.

As shown in FIGS. 21 to 24, a rear portion of the body 350 is provided with a thrust protrusion 380 protruding rearwards. When the thrust face 351 abuts against the mounting member, the thrust protrusion 380 may also abut against the mounting member at the same time, to improve the abutting effect between the thrust structure 340 and the mounting member and secure a mounting position of the indoor unit 1000. Alternatively, abutting surfaces of the thrust protrusion 380 and the mounting member may be configured as planes to make them abut against each other more stable and secure the mounting position of the indoor unit 1000.

As shown in FIG. 24, the body 350 may be provided a grid-like processing groove 354 to reduce the mass of the thrust structure 340. The processing groove 354 may configured as various grid patterns, including grids in a single pattern (such as rectangular grids and triangular grids) and grids in a combination of patterns. Additionally, the processing groove 354 may not run through the body 350 in a front and rear direction during manufacturing, so as to guarantee sufficient strength of the body 350 at the same time of reducing the mass.

As shown in FIGS. 15 to 26, in an embodiment of the present invention, the thrust structure 340 on the indoor unit 1000 is fitted with the wall-hung plate 146, such that the indoor unit 1000 may be hung on the wall or the like. The wall-hung plate 146 is a kind of mounting member to mount the indoor unit 1000 on the wall. The rear portion of the indoor unit 1000 is provided with a hanging groove with a downward opening. The indoor unit 1000 is hung on the wall-hung plate 146 and at least part of the wall-hung plate 146 is located in the hanging groove. As shown in FIGS. 22 and 23, an upper end of the wall-hung plate 146 is provided with a turn-up 146*c* bent forwards. The thrust face 351 may abut against a bottom of the turn-up 146*c*, i.e. the thrust face 351 abuts against a lower surface of the turn-up 146*c*.

Since the thrust structure 340 according to the embodiments of the present invention has the above beneficial technical effect, the indoor unit in the embodiments is assembled firmly and hard to collapse, which improves the safety and reliability.

Figure 17:
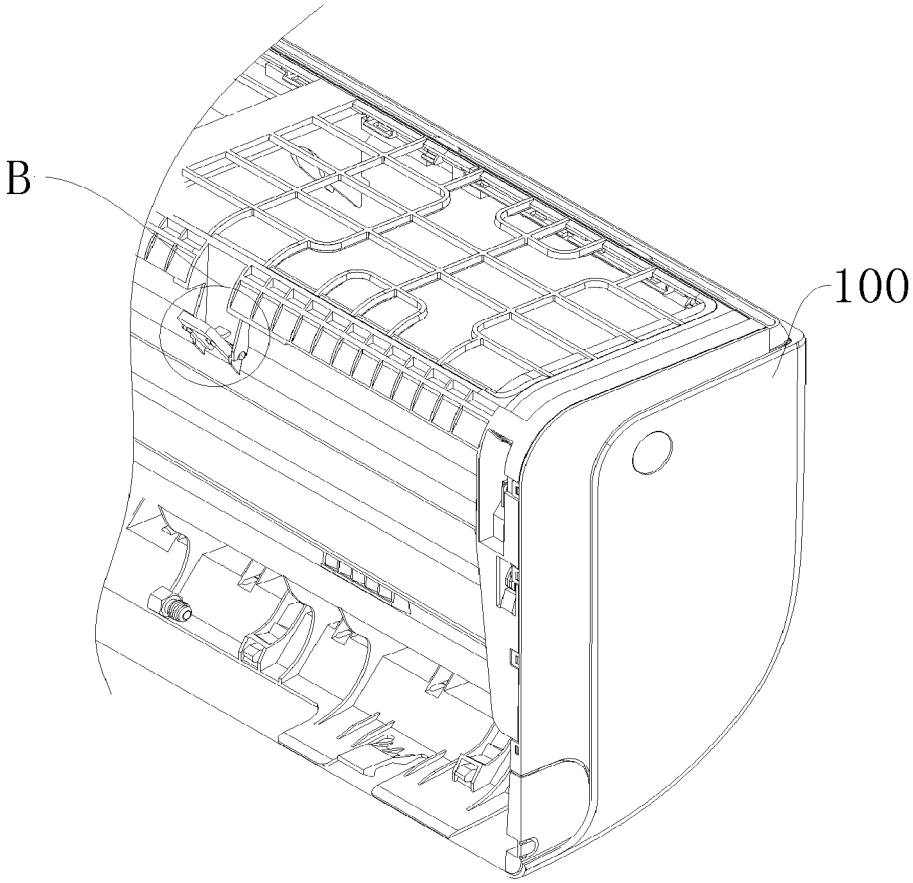
FIG. 17 is an assembly view of a thrust structure and an indoor unit of an air conditioner according to an embodiment of the present invention, in which the thrust structure is in a first position.
Figure 18:
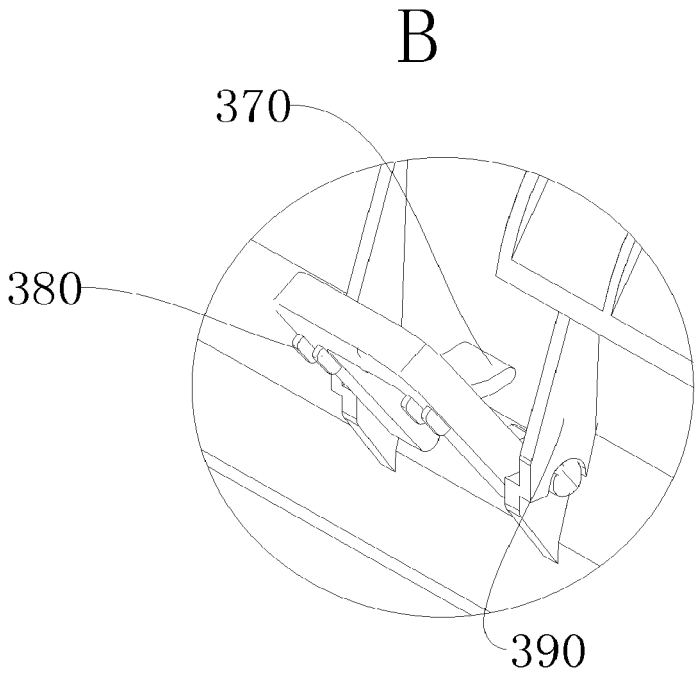
FIG. 18 is an enlarged view of part B in FIG. 17.
Figure 19:
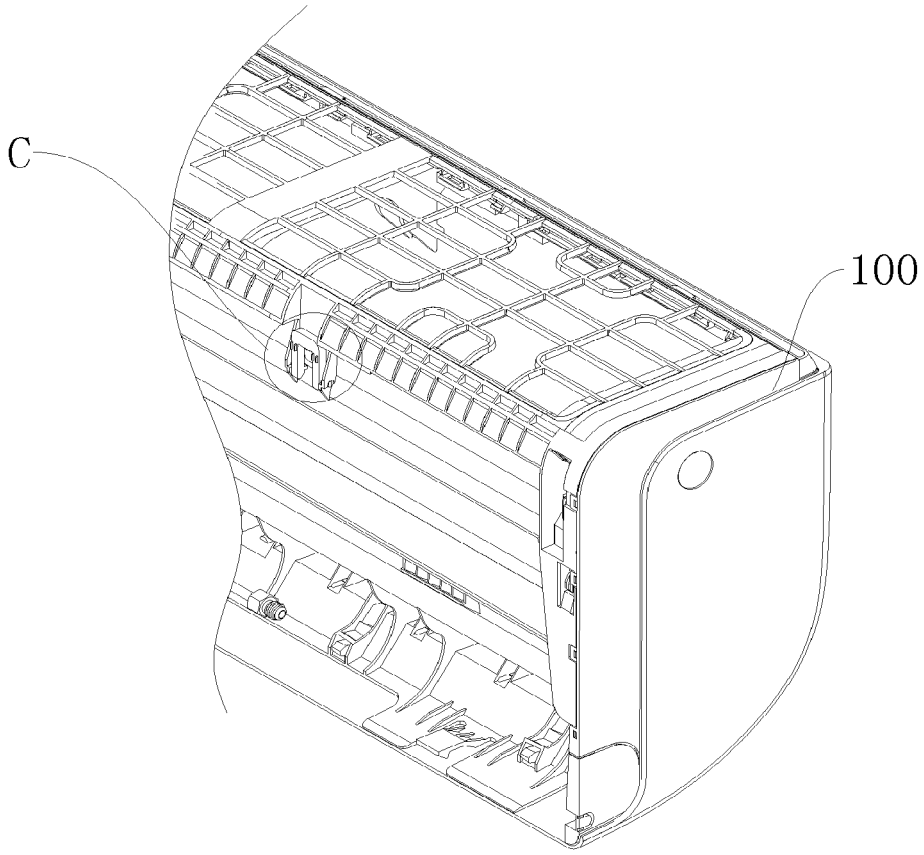
FIG. 19 is an assembly view of the thrust structure and the indoor unit of the air conditioner according to the embodiment of the present invention, in which the thrust structure is in a second position.
Figure 20:
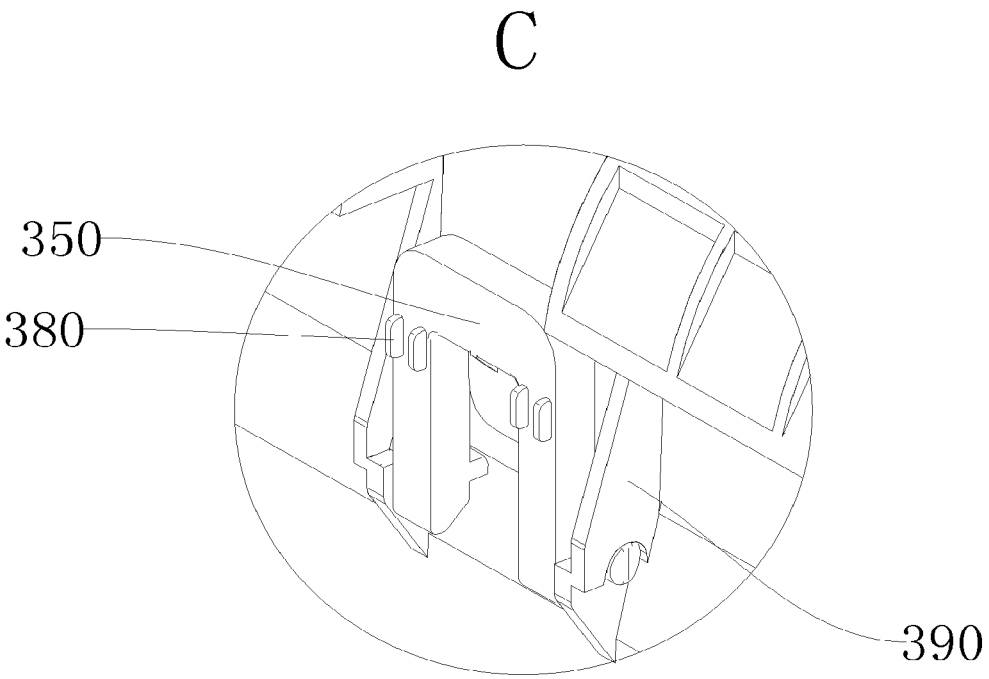
FIG. 20 is an enlarged view of part C in FIG. 19.
Figure 21:
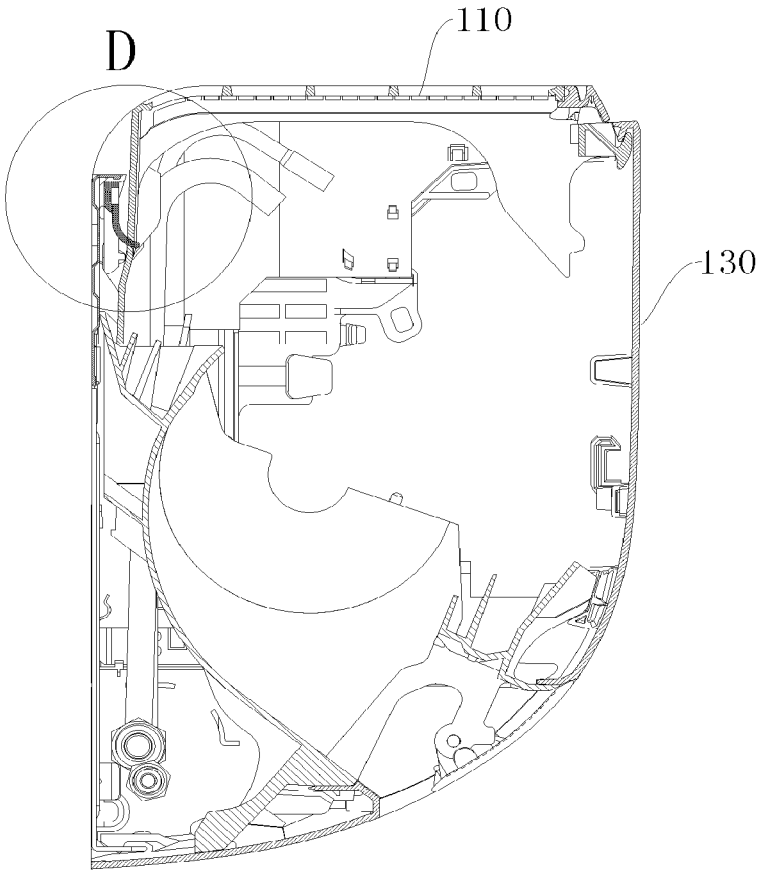
FIG. 21 is a sectional view of an indoor unit of an air conditioner according to an embodiment of the present invention.

Specifically, without any external force, the thrust structure 340 normally open outwards under the action of the resilient arm 370. That is, the upper end of the body 350 moves rearwards, away from the rear wall face of the indoor unit 1000, and opens, as shown in FIGS. 17 and 18. At this moment, a certain angle exists between the body 350 and the indoor unit 1000, i.e. an opening angle of the thrust structure 340. Meanwhile, due to the fitting between the stopping ramp 352 and the rear portion of the indoor unit 1000, the opening angle of the thrust structure 340 is definite. That is, when the stopping ramp 352 abuts against the rear portion of the indoor unit 1000, the thrust structure 340 has the maximum opening angle.

After the indoor unit 1000 pivots by a certain angle, the indoor unit may be hung on the wall-hung plate 146 from the angle formed between the opened thrust structure 340 and the indoor unit 1000, and the assembling is convenient.

Moreover, a center of gravity of the indoor unit 1000 is outside of the wall-hung plate 146, i.e. the center of gravity of the indoor unit 1000 is not in a vertical plane where the wall-hung plate 146 is. Due to the gravity, a lower side of the indoor unit 1000 will press against the wall-hung plate 146. At this moment, the wall-hung plate 146 abuts against the thrust protrusion 380 of the thrust structure 340 and pushes it forwards to make the thrust face 351 abut against a lower edge of the turn-up 146*c* of the wall-hung plate 146. Thus, the indoor unit 1000 may be fixed in the vertical direction.

Further, even if a lower portion of the indoor unit 1000 is slightly lifted by a certain angle, i.e. the indoor unit 1000 pivots counterclockwise by the certain angle, the thrust structure 340 still abuts against the mounting member, and hence still plays the role of thrusting.

When the lower portion of the indoor unit 1000 is lifted by an angle big enough, i.e. the indoor unit 1000 pivots counterclockwise by the angle big enough, a relatively large angle will be formed between the indoor unit 1000 and the mounting member. The thrust structure 340 is able to return to its initial position due to an abutting force applied by the resilient arm 370 thereof. That is, the thrust structure 340 is able to be opened, such that the indoor unit 1000 may be taken out smoothly, and is convenient to disassemble or assemble.

The thrust structure 340 according to the embodiments of the present invention is small in size, convenient to disassemble or assemble, simple, beneficial and practical without mounting difficulty increase, so the thrust structure 340 can be applied to wall-mounted air conditioners of various structure types.

It should be understood that the structure of mounting the thrust structure 340 to the wall-hung plate 146 includes various types. Alternatively, the rear portion of the indoor unit 1000 may be provided with mounting ribs 390 protruding rearwards and disposed in pairs, and the thrust structure 340 may be pivotably mounted between two mounting ribs 390.

Figure 16:
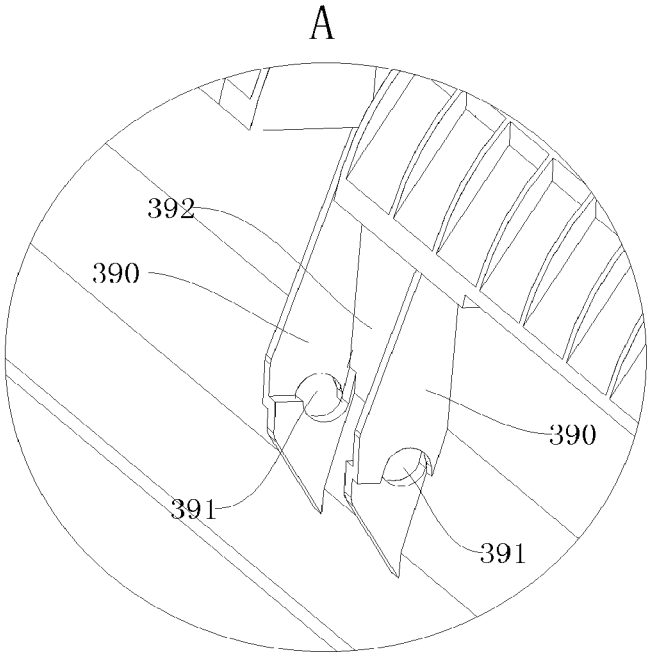
FIG. 16 is an enlarged view of part A in FIG. 15.

Specifically, as shown in FIG. 16, the rear portion of the indoor unit 1000 may be provided with the mounting ribs 390 protruding rearwards. Two mounting ribs 390 make up a pair to secure one thrust structure 340. That is, the two mounting ribs 390 cooperate with each other to constitute a mounting portion for mounting the thrust structure 340. The two mounting ribs 390 are spaced apart from each other in a left and right direction to form a mounting space 392, and each mounting rib 390 is provided with a pivot hole 391. The body 350 may be accommodated in the mounting space 392, and two pivots 360 are inserted in corresponding pivot holes 391, such that the body 350 can pivot between the first position and the second position when connected to the indoor unit 1000, in which the connection is secured and the pivot is smooth. The thrust structure 340 facilitates the assembling and disassembling.

When the body 350 is mounted to the mounting ribs 390, the free end 371 of the resilient arm 370 may abut against a front wall face of the mounting space 392, i.e. a rear surface of the indoor unit 1000. As shown in FIG. 24, one pivot 360 is disposed at each of a left side and a right side of the body 350, and each pivot 360 extends in a horizontal direction away from the body 350. Two pivots 360 are located above stopping ramps 352 and disposed adjacent to the stopping ramps 352. This kind of thrust structure 340 can pivot flexibly and have a good thrusting effect.

Preferably, two thrust structures 340 may be provided on the indoor unit 1000 and spaced apart from each other in the left and right direction. The two thrust structures 340 may limit the degree of freedom of the upward movement of the indoor unit 1000 at the same time, so as to make the mounting of the indoor unit 1000 firm and reliable without considerably cost increase.

Figure 27:
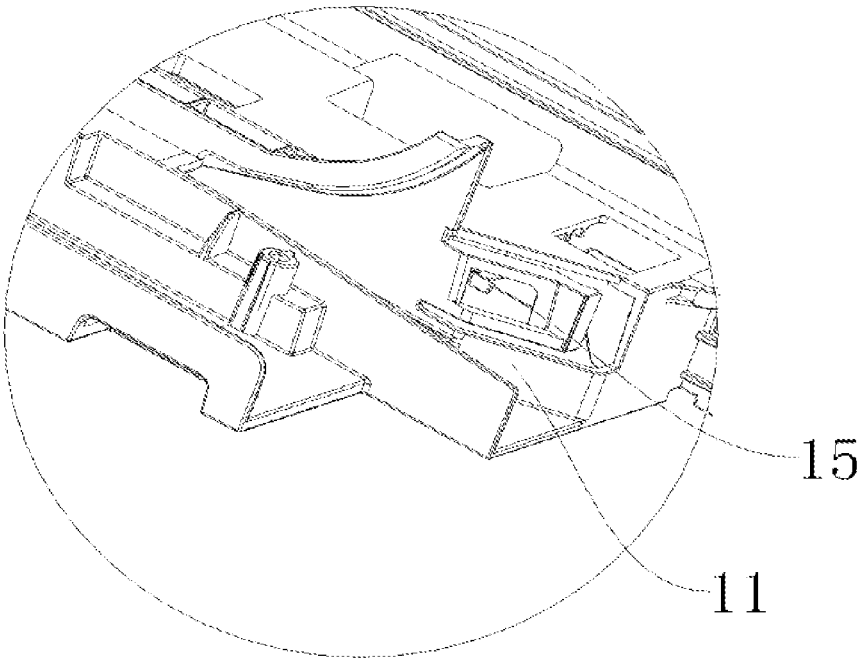
FIG. 27 is an enlarged view of part F in FIG. 1.
Figure 28:
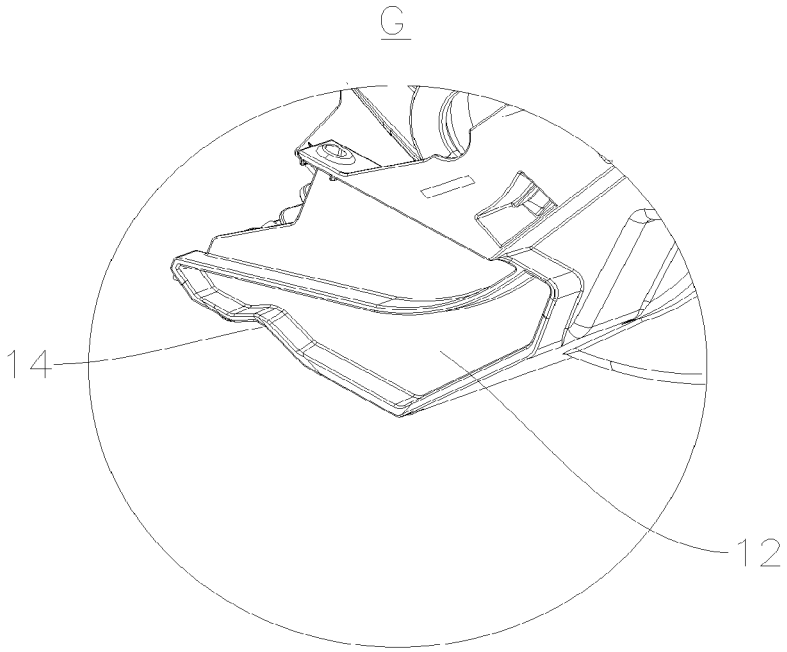
FIG. 28 is an enlarged view of part G in FIG. 1.

In some specific embodiments of the present invention, with reference to FIGS. 27 and 28, the indoor unit 1000 may further include a guide assembly for guiding the lower base plate 120 in a process of mounting and dismounting the lower base plate 120. The guide assembly may include a guide groove 11 and a guide rail 12 fitted with the guide groove 11. The guide groove 11 is provided in the upper base plate 110, and the guide rail 12 is disposed on the lower base plate 120. Further, the guide groove 11 may be provided with a limiting protrusion therein, the guide rail 12 may be provided with a limiting groove 14, and the limiting protrusion is fitted in the limiting groove 14. Through the fitting between the guide groove 11 and the guide rail 12, the upper base plate 110 and the lower base plate 120 may be conveniently mounted or dismounted. Through the fitting between the limiting protrusion and the limiting groove 14, the guide rail 12 and the guide groove 11 are limited by each other to improve the mounting stability of the upper base plate 110 and the lower base plate 120.

Alternatively, with reference to FIGS. 27 and 28, the upper base plate 110 may be provided with a connecting groove 15, the lower base plate 120 may be provided with a connecting protrusion, and the connecting protrusion is fitted in the connecting groove 15, so as to make it convenient to mount or dismount the upper base plate 110 and the lower base plate 120, and improve the stability when they are assembled. Furthermore, the lower base plate may be mounted to the upper base plate via a threaded fastener.

The other configurations and operations of the indoor unit 1000 according to the embodiments of the present invention are known to those skilled in the art, which will not be described in detail herein.

In the specification, it is to be understood that terms such as "central," "longitudinal," "lateral," "length," "width," "thickness," "upper," "lower," "front," "rear," "left," "right," "vertical," "horizontal," "top," "bottom," "inner," "outer," "clockwise," and "counterclockwise" should be construed to refer to the orientation or position as then described or as shown in the drawings under discussion. These relative terms are for convenience of description and do not require that the present invention be constructed or operated in a particular orientation.

In addition, terms such as "first" and "second" are used herein for purposes of description and are not intended to indicate or imply relative importance or significance or to imply the number of indicated technical features. Thus, the feature defined with "first" and "second" may include one or more of this feature. In the description of the present invention, "a plurality of" means two or more than two, unless specified otherwise.

In the present invention, unless specified or limited otherwise, the terms "mounted," "connected," "coupled," "fixed" and the like are used broadly, and may be, for example, fixed connections, detachable connections, or integral connections; may also be mechanical or electrical connections; may also be direct connections or indirect connections via intervening structures; may also be inner communications of two elements, which can be understood by those skilled in the art according to specific situations.

In the present invention, unless specified or limited otherwise, a structure in which a first feature is "on" or "below" a second feature may include an embodiment in which the first feature is in direct contact with the second feature, and may also include an embodiment in which the first feature and the second feature are not in direct contact with each other, but are contacted via an additional feature formed therebetween. Furthermore, a first feature "on," "above," or "on top of" a second feature may include an embodiment in which the first feature is right or obliquely "on," "above," or "on top of" the second feature, or just means that the first feature is at a height higher than that of the second feature; while a first feature "below," "under," or "on bottom of" a second feature may include an embodiment in which the first feature is right or obliquely "below," "under," or "on bottom of" the second feature, or just means that the first feature is at a height lower than that of the second feature.

Reference throughout this specification to "an embodiment," "some embodiments," "an example," "specific examples" or "some examples" means that a particular feature, structure, material, or characteristic described in connection with the embodiment or example is included in at least one embodiment or example of the present invention. Thus, the appearances of the above phrases throughout this specification are not necessarily referring to the same embodiment or example of the present invention. Furthermore, the particular features, structures, materials, or characteristics may be combined in any suitable manner in one or more embodiments or examples. Those skilled in the art can integrate and combine different embodiments or examples and the features in different embodiments or examples in the specification.

Although embodiments of the present invention have been shown and illustrated, it shall be understood by those skilled in the art that various changes, modifications, alternatives and variants without departing from the principle and spirit of the present invention are acceptable.

What is claimed is:

1. An indoor unit of an air conditioner, comprising:

a housing comprising an upper base plate provided with an air inlet, a lower base plate detachably mounted to the upper base plate and provided with an air outlet, and a front cover detachably mounted to the upper base plate;

a heat exchanger mounted on the upper base plate;

a fan detachably mounted to the lower base plate;

a thrust structure comprising a body, the body being disposed to a rear portion of the indoor unit and having a thrust face abutting against a mounting member to limit a degree of freedom of upward movement of the indoor unit; and a wall-hung plate for mounting on a wall, wherein the rear portion of the indoor unit is provided with a hanging groove with a downward opening, the indoor unit is hung on the wall-hung plate, an upper end of the wall-hung plate is provided with a turn-up bent forwards, and the thrust face is configured to abut against a bottom of the turn-up.

2. The indoor unit according to claim 1, wherein the upper base plate comprises:

a rear baffle, to which the heat exchanger is mounted;

an upper cover plate having a rear edge connected with an upper edge of the rear baffle and provided with the air inlet;

a left end plate having a rear edge connected with a left edge of the rear baffle and an upper edge connected with a left edge of the upper cover plate; and a right end plate having a rear edge connected with a right edge of the rear baffle and an upper edge connected with a right edge of the upper cover plate, wherein the lower base plate is detachably mounted to the left end plate and the rear baffle, the left end plate is located at a left side of the lower base plate and the right end plate is located at a right side of the lower base plate.

3. The indoor unit according to claim 1, wherein the front cover defines a covering chamber, the upper base plate and the lower base plate are disposed in the covering chamber and covered by the front cover, and the front cover is provided with an air supply port in a position corresponding to the air outlet.

4. The indoor unit according to claim 3, wherein the front cover comprises:

a front panel covering front surfaces of the upper base plate and the lower base plate;

a lower panel having a front edge connected with a lower edge of the front panel, and covering a lower surface of the lower base plate, wherein the air supply port is provided at a position where the front panel and the lower panel are connected;

a left panel having a front edge connected with a left edge of the front panel and a lower edge connected with a left edge of the lower panel, and rotatably mounted to a left side face of the upper base plate and covering the left side face of the upper base plate; and a right panel having a front edge connected with a right edge of the front panel and a lower edge connected with a right edge of the lower panel, and rotatably mounted to a right side face of the upper base plate and covering the right side face of the upper base plate.

5. The indoor unit according to claim 1, wherein the fan comprises:

a fan wheel detachably mounted to the lower base plate; and a motor detachably mounted to the lower base plate and connected with the fan wheel in a transmission way.

6. The indoor unit according to claim 5, wherein a motor mounting groove is provided in the lower base plate, the upper base plate is provided with a water receiving cover, the motor is mounted in the motor mounting groove, and the water receiving cover is located below the heat exchanger and presses the motor in the motor mounting groove.

7. The indoor unit according to claim 1, wherein an upper end face of the body is configured as the thrust face.

8. The indoor unit according to claim 7, wherein:

a lower end of the body has a stopping ramp, the body is pivotably connected to the rear portion of the indoor unit between a first position and a second position, when the body is in the first position, the stopping ramp abuts against a rear wall face of the indoor unit to make an upper end of the body move rearwards, away from the rear wall of the indoor unit, and open, and when the body is in the second position, the thrust face abuts upwards against the mounting member to limit the degree of freedom of the upward movement of the indoor unit.

9. The indoor unit according to claim 8, wherein the body is provided with a resilient arm extending forwards and downwards, and a free end of the resilient arm normally abuts against the rear portion of the indoor unit.

10. The indoor unit according to claim 8, wherein a pivot is disposed at each of two sides of the body, and a pivot hole is provided in the indoor unit to be fitted with the pivot.

11. The indoor unit according to claim 1, wherein a rear portion of the body is provided with a thrust protrusion protruding rearwards.

12. The indoor unit according to claim 1, wherein the rear portion of the indoor unit is provided with mounting ribs protruding rearwards and disposed in pairs, and the thrust structure is pivotably mounted between two mounting ribs.

13. The indoor unit according to claim 1, further comprising a guide assembly for guiding the lower base plate in a process of mounting and dismounting the lower base plate, wherein the guide assembly comprises:

a guide groove provided in the upper base plate, and a guide rail fitted with the guide groove and disposed on the lower base plate.

14. The indoor unit according to claim 1, further comprising a supporting rod, wherein the supporting rod is rotatably mounted to a wall-hung plate or the housing between an unfolded position where a lower portion of the supporting rod supporting the housing is away from the wall-hung plate and a folded position where the supporting rod abuts against the wall-hung plate or the housing.

15. The indoor unit according to claim 14, wherein the supporting rod comprises:

a first supporting rod rotatably mounted to the wall-hung plate between the unfolded position and the folded position; and a second supporting rod rotatably mounted to the first supporting rod between a protruding position where the second supporting rod protrudes and a retracting position where the second supporting rod retracts.

16. The indoor unit according to claim 15, wherein the wall-hung plate is provided with a hook, the first supporting rod is provided with a first rotating shaft, and the first rotating shaft is rotatably fitted with the hook.

17. The indoor unit according to claim 15, wherein the wall-hung plate is provided with a folded positioning clasp, a first supporting plate is provided with a folded positioning boss, and the folded positioning clasp is snap-fitted over the folded positioning boss when the first supporting rod is in the folded position.

18. The indoor unit according to claim 15, wherein the first supporting rod is provided with a shaft hole, the second supporting rod is provided with a second rotating shaft, and the second rotating shaft is rotatably fitted in the shaft hole.

19. The indoor unit according to claim 15, wherein:

the first supporting rod is provided with a retracting positioning boss, the second supporting rod is provided with a retracting positioning groove, and the retracting positioning boss is snap-fitted in the retracting positioning groove when the second supporting rod is in the retracting position; or the first supporting rod is provided with a protrusion positioning boss, the second supporting rod is provided with a protrusion positioning groove, and the protrusion positioning boss is snap-fitted in the protrusion positioning groove when the second supporting rod is in the protruding position.

20. The indoor unit according to claim 15, wherein the second supporting rod is provided with a bearing shoulder, and the bearing shoulder abuts against the first supporting rod when the second supporting rod is in the protruding position.

21. The indoor unit according to claim 14, wherein a rear surface of the housing is provided with a supporting groove that is provided with a plurality of supporting ribs spaced apart from one another, when the supporting rod is in the unfolded position, the supporting rod is fitted in the supporting groove and supported on the plurality of supporting ribs.

22. An indoor unit of an air conditioner, comprising:

a housing comprising:

an upper base plate provided with an air inlet and a water receiving cover;

a lower base plate detachably mounted to the upper base plate and provided with an air outlet and a motor mounting groove; and a front cover detachably mounted to the upper base plate;

a heat exchanger mounted on the upper base plate;

a fan detachably mounted to the lower base plate, the fan comprising:

a fan wheel detachably mounted to the lower base plate; and a motor detachably mounted in the motor mounting groove and connected with the fan wheel in a transmission way; and a thrust structure comprising a body, the body being disposed to a rear portion of the indoor unit and having a thrust face abutting against a mounting member to limit a degree of freedom of upward movement of the indoor unit, wherein the water receiving cover is located below the heat exchanger and presses the motor in the motor mounting groove.

23. An indoor unit of an air conditioner, comprising:

a housing comprising an upper base plate provided with an air inlet, a lower base plate detachably mounted to the upper base plate and provided with an air outlet, and a front cover detachably mounted to the upper base plate;

a heat exchanger mounted on the upper base plate;

a fan detachably mounted to the lower base plate; and a thrust structure comprising a body, wherein:

an upper end face of the body is configured as a thrust face, a lower end of the body having a stopping ramp, the body is pivotably connected to a rear portion of the indoor unit between a first position and a second position, when the body is in the first position, the stopping ramp abuts against a rear wall face of the indoor unit to make an upper end of the body move rearwards, away from the rear wall of the indoor unit, and open, and when the body is in the second position, the thrust face abuts upwards against a mounting member to limit a degree of freedom of upward movement of the indoor unit.

* * * * *